US009701508B2

(12) United States Patent
Diamond

(10) Patent No.: US 9,701,508 B2
(45) Date of Patent: Jul. 11, 2017

(54) HYBRID DISPENSER SYSTEMS

(71) Applicant: Georgia-Pacific Consumer Products LP, Atlanta, GA (US)

(72) Inventor: Russell Diamond, Neenah, WI (US)

(73) Assignee: GEORGIA-PACIFIC CONSUMER PRODUCTS LP, Atlanta, GA (US)

( * ) Notice: Subject to any disclaimer, the term of this patent is extended or adjusted under 35 U.S.C. 154(b) by 58 days.

(21) Appl. No.: 15/008,629

(22) Filed: Jan. 28, 2016

(65) Prior Publication Data

US 2016/0227970 A1 Aug. 11, 2016

Related U.S. Application Data

(60) Provisional application No. 62/113,151, filed on Feb. 6, 2015.

(51) Int. Cl.

| | |
|---|---|
| ***A47K 10/38*** | (2006.01) |
| ***B65H 43/00*** | (2006.01) |
| ***A47K 10/36*** | (2006.01) |
| ***B65H 35/00*** | (2006.01) |
| ***B26F 3/02*** | (2006.01) |

(52) U.S. Cl.

CPC ..... *B65H 43/00* (2013.01); *A47K 10/3612* (2013.01); *A47K 10/3625* (2013.01); *B26F 3/02* (2013.01); *B65H 35/006* (2013.01); *B65H 35/0086* (2013.01); *B65H 2404/14* (2013.01)

(58) Field of Classification Search

CPC .... A47K 10/38; B65H 16/021; B65H 15/005; B65H 43/00

USPC ..... 318/140, 430, 434, 558; 242/563, 564; 312/34.8

See application file for complete search history.

(56) References Cited

U.S. PATENT DOCUMENTS

| | | | |
|---|---|---|---|
| 3,858,951 | A | 1/1975 | Rasmussen |
| 4,666,099 | A | 5/1987 | Hoffman et al. |
| 4,712,461 | A | 12/1987 | Rasmussen |
| 4,786,005 | A | 11/1988 | Hoffman et al. |

(Continued)

FOREIGN PATENT DOCUMENTS

| | | | |
|---|---|---|---|
| EP | 0235446 | A1 | 9/1987 |
| EP | 2415717 | A1 | 2/2012 |

(Continued)

*Primary Examiner* — Bentsu Ro

(74) *Attorney, Agent, or Firm* — Eversheds Sutherland (US) LLP

(57) ABSTRACT

Certain hybrid dispenser systems and methods of dispensing sheet product are provided. In one example, the method includes dispensing, by the dispenser, an exposed tail of sheet product upon activation of a proximity sensor associated with the dispenser. The method includes dispensing a second length of sheet product in response to a user manually exerting a pull force on the exposed tail. The method includes generating electrical energy using an electrical generator of the dispenser. An amount of electrical energy generated by the electrical generator is based in part on the second length of sheet product pulled by the user. The method includes charging an energy storage device electrically coupled to the electrical generator by transferring energy from the electrical generator to the energy storage device, and modifying the pull force the user exerts to dispense the second length by adjusting an energy transfer rate from the electrical generator to the energy storage device.

23 Claims, 14 Drawing Sheets

(56) References Cited

U.S. PATENT DOCUMENTS

| | | | | |
|---|---|---|---|---|
| 4,807,824 | A | 2/1989 | Gains et al. | |
| 6,074,178 | A | 6/2000 | Bishop et al. | |
| 6,105,898 | A | 8/2000 | Byrd et al. | |
| 6,293,486 | B1 * | 9/2001 | Byrd | A47K 10/36 242/563 |
| 6,314,850 | B1 | 11/2001 | Morand | |
| 6,407,484 | B1 | 6/2002 | Oliver et al. | |
| 6,820,785 | B2 | 11/2004 | Kapiloff | |
| 6,892,620 | B2 | 5/2005 | Kapiloff | |
| 7,530,477 | B2 | 5/2009 | Ophardt | |
| 7,793,882 | B2 | 9/2010 | Reinsel et al. | |
| 7,896,285 | B2 | 3/2011 | Wruck, Jr. et al. | |
| 7,987,756 | B2 | 8/2011 | Lewis et al. | |
| 8,042,911 | B2 | 10/2011 | Sasaki | |
| 8,082,827 | B2 | 12/2011 | Friesen et al. | |
| 8,201,707 | B2 | 6/2012 | Ophardt | |
| 8,215,523 | B2 | 7/2012 | Ophardt | |
| 8,240,301 | B2 | 8/2012 | Spaargaren et al. | |
| 8,297,160 | B2 | 10/2012 | Friesen et al. | |
| 8,382,026 | B2 | 2/2013 | Keily et al. | |
| 8,402,872 | B2 | 3/2013 | Friesen et al. | |
| 8,408,487 | B2 | 4/2013 | Rodrian et al. | |
| 8,432,062 | B2 | 4/2013 | Greene et al. | |
| 8,434,709 | B2 | 5/2013 | Troutman et al. | |
| 8,528,790 | B2 | 9/2013 | Wegelin | |
| 8,528,851 | B2 | 9/2013 | Friesen et al. | |
| 8,555,761 | B2 | 10/2013 | Keily et al. | |
| 8,621,245 | B2 | 12/2013 | Shearer et al. | |
| 8,632,030 | B2 | 1/2014 | Troutman et al. | |
| 8,657,225 | B2 | 2/2014 | Hagleitner | |
| 8,672,187 | B2 | 3/2014 | Ophardt | |
| 8,684,236 | B2 | 4/2014 | Ophardt | |
| 8,733,596 | B2 | 5/2014 | Ophardt et al. | |
| 8,739,790 | B2 | 6/2014 | Bruna | |
| 8,783,511 | B2 | 7/2014 | Snodgrass | |
| 9,248,988 | B2 | 2/2016 | Keily et al. | |
| 2007/0176774 | A1 | 8/2007 | Jahrling et al. | |
| 2010/0051737 | A1 | 3/2010 | Rodrian et al. | |
| 2010/0102101 | A1 | 4/2010 | Keily et al. | |
| 2010/0170979 | A1 * | 7/2010 | Lewis | A47K 5/06 242/563.2 |
| 2010/0213212 | A1 | 8/2010 | Custodis et al. | |
| 2010/0219206 | A1 | 9/2010 | Ophardt | |
| 2010/0252569 | A1 | 10/2010 | Pelfrey | |
| 2010/0288788 | A1 | 11/2010 | Ophardt | |
| 2011/0133019 | A1 | 6/2011 | Keily et al. | |
| 2011/0303762 | A1 | 12/2011 | Wegelin et al. | |
| 2012/0001433 | A1 | 1/2012 | Mowad | |
| 2012/0104785 | A1 | 5/2012 | Hixson et al. | |
| 2012/0234867 | A1 | 9/2012 | Ophardt | |
| 2012/0318386 | A1 | 12/2012 | Guzman | |
| 2013/0026282 | A1 | 1/2013 | Friesen et al. | |
| 2013/0175296 | A1 | 7/2013 | Gray et al. | |
| 2013/0197707 | A1 | 8/2013 | Keily et al. | |
| 2014/0091168 | A1 | 4/2014 | Keily et al. | |
| 2014/0111032 | A1 | 4/2014 | Shearer et al. | |
| 2014/0124531 | A1 | 5/2014 | Muderlak et al. | |
| 2014/0138401 | A1 | 5/2014 | Ophardt et al. | |
| 2014/0217123 | A1 | 8/2014 | Ophardt et al. | |
| 2014/0232319 | A1 | 8/2014 | Wegelin et al. | |

FOREIGN PATENT DOCUMENTS

| | | | |
|---|---|---|---|
| SE | PCT/SE2012/050759 | | 1/2014 |
| WO | 2013169438 | A1 | 11/2013 |
| WO | 2014007689 | A1 | 1/2014 |
| WO | 2014120352 | A1 | 8/2014 |

* cited by examiner

HYBRID DISPENSER SYSTEMS

FIELD OF THE DISCLOSURE

The present disclosure generally relates to hybrid dispenser systems, as well as methods of harvesting energy generated at the hybrid dispenser systems described herein.

BACKGROUND

Dispenser systems may be used to dispense various consumer products, such as paper towels, disposable wipes, and other sheet products. Some dispenser systems may be electrically powered for automatic dispensing, for example, motion activated paper towel dispenser systems. Such dispenser systems may reduce the need for users to contact a portion of the dispenser, for example a lever or actuator used to dispense the paper towel, which may result in improved hygiene and convenience for users. However, electrical power may not be readily available at the location of the dispenser, therefore requiring batteries or other depletable energy storage devices to power the automatic dispensers. Because the batteries or energy storage devices may have limited capacity and/or lifespans, frequent replacement or observation may be required, resulting in increased maintenance costs associated with the dispenser system. Accordingly, there is a need to reduce or remove the need for depletable energy storage devices used to power automatic dispenser systems.

SUMMARY

Certain embodiments of the disclosure provide hybrid dispenser systems and methods for using the same. In particular, the present disclosure relates to hybrid dispenser systems and methods for harvesting energy generated at the hybrid dispenser systems. According to one or more embodiments of the disclosure, a method of dispensing sheet product from a dispenser is provided. The method includes dispensing, by the dispenser, an exposed tail of sheet product upon activation of a proximity sensor associated with the dispenser, where the exposed tail has a first length. The method includes dispensing a second length of sheet product in response to a user manually exerting a pull force on the exposed tail, where a total length of sheet product dispensed in a dispensing cycle includes the first length and the second length. The method includes generating electrical energy using an electrical generator of the dispenser. An amount of electrical energy generated by the electrical generator is based at least in part on the second length of sheet product manually pulled by the user. The method includes charging an energy storage device electrically coupled to the electrical generator by transferring energy from the electrical generator to the energy storage device, and adjusting an energy transfer rate from the electrical generator to the energy storage device to modify the pull force which the user must exert to dispense the second length of sheet product.

According to one or more embodiments of the disclosure, a hybrid dispenser system is provided. The hybrid dispenser system includes a dispensing mechanism configured to dispense an exposed tail of sheet product having a first length, and an energy storage device configured to power the dispensing mechanism. The system includes an electrical generator configured to transfer energy to the energy storage device, the electrical generator configured to generate electrical energy when a user, exerting a pull force on the exposed tail, manually pulls a second length of sheet product from the dispenser system. An amount of electrical energy generated by the electrical generator is based at least in part on the second length of sheet product manually pulled by the user. The system includes a current manipulation device configured to adjust an energy transfer rate from the electrical generator to the energy storage device to modify the pull force the user exerts to dispense the second length.

According to one or more embodiments of the disclosure, a hybrid dispenser system is provided. The hybrid dispenser system includes a dispensing mechanism, a proximity sensor configured to activate the dispensing mechanism to dispense an exposed tail of sheet product having a first length, and an energy storage device configured to power the dispensing mechanism and the proximity sensor. The system includes an electrical generator configured to transfer energy to the energy storage device, the electrical generator configured to generate electrical energy when a user, exerting a pull force on the exposed tail, manually pulls a second length of sheet product from the dispenser system. An amount of electrical energy generated by the electrical generator is based at least in part on the second length of sheet product manually pulled by the user. The system includes a current manipulation device configured to adjust an energy transfer rate from the electrical generator to the energy storage device to modify the pull force the user exerts to dispense the second length.

Other systems and methods according to various embodiments of the disclosure will be apparent to one skilled in the art upon examination of the following figures and the detailed description. All other features and aspects, as well as other systems and methods, are intended to be included within the description and are intended to be within the scope of the accompanying claims.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

Figure 1:
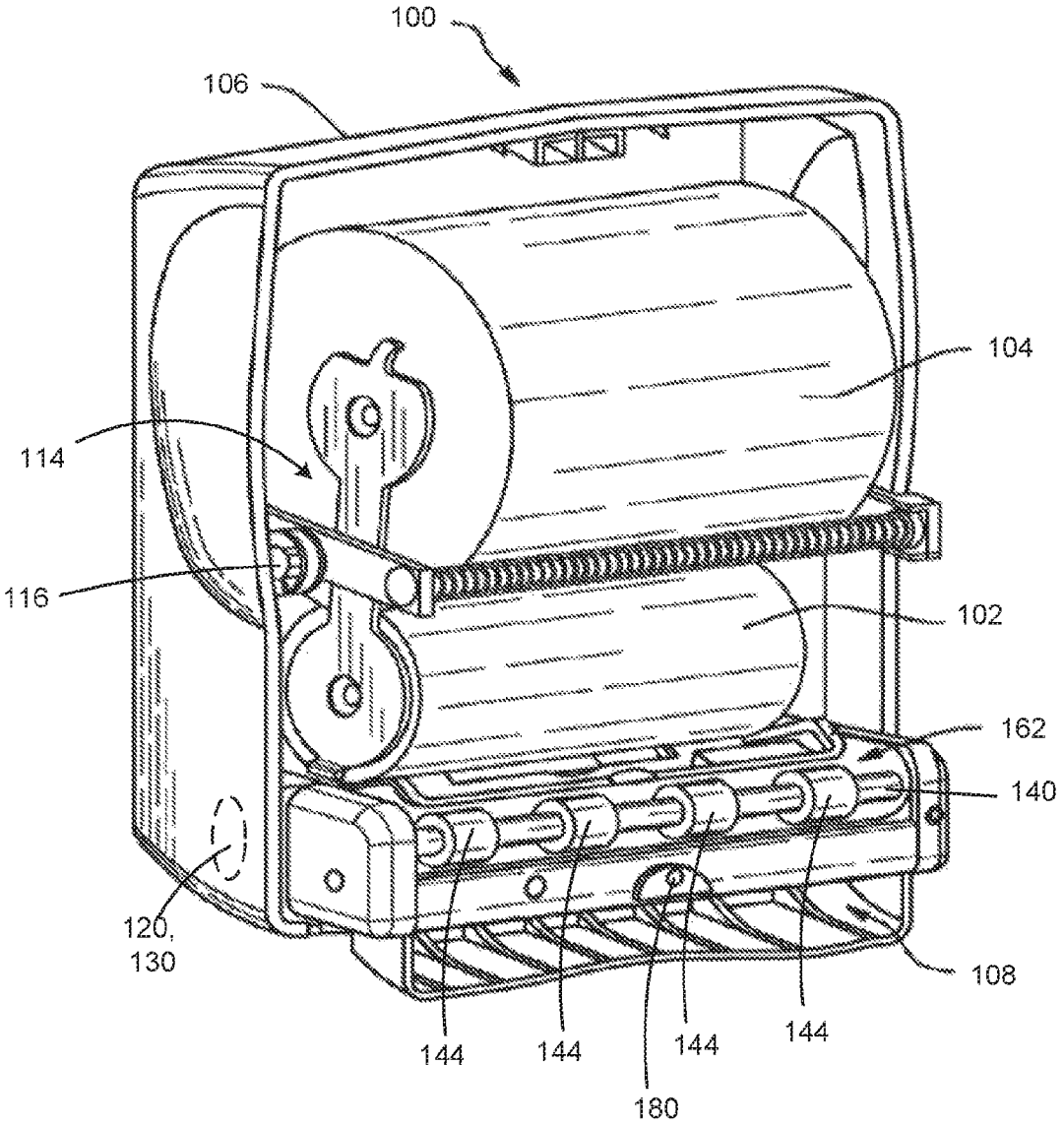
FIGS. 1-5 illustrate a hybrid dispenser system in accordance with one or more embodiments of the present disclosure.

Certain implementations will now be described more fully below with reference to the accompanying drawings, in which various implementations and/or aspects are shown. However, various aspects may be implemented in many different forms and should not be construed as limited to the implementations set forth herein; rather, these implementations are provided so that this disclosure will be thorough and complete, and will fully convey the scope of the disclosure to those skilled in the art.

DETAILED DESCRIPTION

The present disclosure is directed to hybrid dispenser systems and methods for harvesting energy generated at the hybrid dispenser systems described herein. Broadly, the systems and methods described herein may reduce or remove the need for replacing power sources at dispenser systems or at auxiliary systems electrically coupled to dispenser systems, such as air fresheners, by harvesting and storing energy generated by users of the dispenser systems. The dispenser systems described herein may be configured to generate electrical energy from motion or force input by users who manually pull sheet product from the dispenser system. Specifically, in some embodiments of the present disclosure, as users pull sheet product from the dispenser system, rotational motion is imparted to a drive roller as the sheet product is dispensed. The drive roller may be coupled an electrical generator. The electrical generator converts the rotational motion into electrical energy, and the resulting electrical energy is used to charge or recharge an energy storage device included in the dispenser system. Energy stored in the energy storage device may later be used, in some embodiments, during an automated portion of a dispensing cycle to (i) dispense a first portion of sheet product, which may be referred to herein as an exposed tail, that subsequently may be manually pulled by users during a manual portion of the dispensing cycle, and/or (ii) to power auxiliary components of the dispenser system, such as sensors, air fresheners, and the like. In some embodiments, stored energy may be used to mechanically advance an exposed tail of the sheet product after a dispensing cycle is complete, while in other embodiments, an exposed tail may be dispensed manually via user pulling. In one example, after a user manually pulls an exposed tail and removes sheet product from the dispenser, a subsequent exposed tail may be actively advanced, such that the subsequent exposed tail is waiting for another user. In other embodiments, stored energy may be used to advance an exposed tail of the sheet product upon activation of a component of the dispenser system that indicates a user is waiting. For example, the exposed tail may be advanced after a motion or proximity sensor of the dispenser system is activated, such that the exposed tail is not waiting, or hanging as also referred to herein, to be pulled for long time periods, during which contamination may occur. Certain embodiments may be configured to dispense exposed tails manually, and the resultant energy generated by the manual dispensing may be harvested.

The systems and methods described herein may allow for management and/or adjustment of pull force required to be input at the dispenser to dispense sheet product. When a user manually pulls an exposed tail of sheet product at the dispenser, the user imparts a pull force on the exposed tail, or the sheet product generally, to pull a length of sheet product from the dispenser in order to remove the sheet product. The pull force the user must input may advantageously be dynamically modified or adjusted by the dispenser systems described herein by manipulation of electrical energy (e.g., current and/or voltage) flowing between the electrical generator and the energy storage device of the dispenser systems. In some embodiments, the pull force is dynamically modified while a user is pulling sheet product from the dispenser system. The pull force the user must exert or exerts to dispense the second length may be modified, in certain embodiments, by managing current flow between components of the dispenser. For example, managing current flowing from an electrical generator of the dispenser system to an energy storage device of the dispenser system impacts the pull force the user must exert. In an instance where current flow is freely flowing (e.g., via shunting current flow) from the electrical generator to the energy storage device, the user may experience a relatively high pull force, while in instances where current is reduced between the electrical generator and the energy storage device, the user may experience a relatively low pull force.

Modifying the pull force the user exerts to dispense the second length may affect a user experience of the dispenser system. For example, a relatively high pull force may result in premature tearing of the sheet product, while a relatively low pull force may result in the user pulling more sheet product than desired. Modifying the pull force may allow sheet product having various properties, such as thickness, to be used with the dispenser system. In one example, relatively thin sheet product may be used with the dispenser system having a pull force modified to a relatively low pull force, to avoid premature tearing of the sheet product.

In embodiments of the disclosure in which the pull force the user must exert to remove sheet product from the dispenser is dynamically modifiable, the pull force may range from a minimum pull force to a maximum pull force while the user pulls sheet product from the dispenser. Dynamically modifying the pull force while the user pulls sheet product may advantageously facilitate management of length of sheet product dispensed per dispense event, as well as reducing an overall input of force a user must exert while pulling sheet product from the dispenser system.

Accordingly, the dispenser systems of the present disclosure may reduce or remove the need for replacing power sources, such as batteries, at dispenser systems by harvesting energy provided by users of the dispenser system and using the harvested energy to charge an energy storage device. The dispenser systems of the present disclosure may further manage and/or adjust pull force needed to dispense sheet product during the manual portion of a dispensing cycle. Certain systems and methods of the present disclosure may therefore beneficially require less frequent observation by maintenance personnel and/or reduced maintenance associated with the dispenser systems.

One or more technical solutions can be achieved by embodiments of the disclosure. For example, in at least one embodiment, rotational motion imparted by a user manually pulling sheet product from a dispenser may be converted into electrical energy, which may be transferred to and stored in an energy storage device. In certain embodiments, current and/or voltage flow between components of the dispenser system may be manipulated or otherwise adjusted to affect the pull force users must input to remove sheet product from the dispenser. Costs associated with replacement of energy storage devices and associated maintenance advantageously may be reduced as a result of using the systems and methods described herein.

These and other embodiments of the disclosure will be described in more detail with reference to the accompanying drawings in the detailed description that follows. This brief introduction, including section titles and corresponding summaries, is provided for the reader's convenience and is not intended to limit the scope of the claims or the proceeding sections. Furthermore, the techniques described above and below may be implemented in a number of ways and in a number of contexts. Several examples of implementations and contexts are provided with reference to the following figures, as described below in more detail. However, the following implementations and contexts are but a few of many.

With reference to FIGS. 1-5, a hybrid dispenser system 100 according to one or more embodiments of the present disclosure is illustrated. The hybrid dispenser system 100 is configured to dispense a sheet product from one or more sheet product rolls, such as a stub roll 102 and/or a main roll 104. A dispensing cycle at the dispenser 100 may include an automated portion, where a first tail having a first length of sheet product is dispensed automatically by the dispenser 100, as well as a manual portion, where a second length of sheet product is dispensed by a user manually pulling the first tail the second length to remove sheet product from the dispenser 100. In some embodiments, a dispensing cycle may include only a manual portion, where energy generated during the dispensing cycle is used to power components of the dispenser system, such as data transmission or wireless communication systems. Other embodiments may include dispensing cycles with electronic assist, where stored energy is used by a motor of the dispenser to assist users during a manual portion of the dispensing cycle, for example, by reducing the pull force the user exerts to remove sheet product.

The hybrid dispenser system 100 includes a housing 106 with a dispensing opening 108. The housing 106 may be of any suitable size or shape. The dispensing opening 108 is positioned at a lower portion of the hybrid dispenser system 100 and provides access to an exposed tail 110 of the sheet product (shown in FIG. 2). The exposed tail 110 may have an adjustable predetermined length 112, and may be dispensed during the automated portion of the dispensing cycle, as described herein. In the illustrated embodiment, a user is able to pull the sheet product through the dispensing opening 108 by manually pulling the exposed tail 110. In other embodiments, the dispensing opening 108 may be positioned at an upper portion of the hybrid dispenser system, or along a top, bottom, or side surface.

The dispenser 100 includes a roll mount assembly 114 positioned within the housing 106. The stub roll 102 and the main roll 104 are mounted on the roll mount assembly 114 and may be rotatable about joint 116. The stub roll 102 and the main roll 104 may be rolls of sheet product. In the illustrated embodiment, the stub roll 102 is be partially used and therefore has a smaller diameter than the main roll 104. The dispenser 100 further includes (i) a drive roller 140 positioned adjacent to a pinch roller 150, and (ii) a motor 120 mechanically coupled to an electrical generator 130. While illustrated as a combined motor-generator, other embodiments may include discrete motor and generator components that may be mechanically coupled or otherwise operably linked. The dispenser 100 may also include an inverter 170 electrically coupled to the motor 120 and the electrical generator 130. Electrical energy for operating the sheet product dispenser 100 is provided by an energy storage device 200, which may be comprised of one or more rechargeable batteries, capacitors, or the like as described herein. A controller 210 may be configured to operate the dispenser 100 and may be electrically coupled to the motor 120 and one or more sensors included in the dispenser, as described below.

Dispenser 100 includes sheet product rolls 102, 104 that are mounted on rolls or core stock. The sheet product may be any product in sheet form, including paper towels, wipes, tissues, napkins, and the like. The sheet product may have any desired absorbable properties and may be dry or moist sheet product. The sheet product may have any desired physical dimensions, including width and thickness. The sheet product may be perforated at predetermined sheet length intervals, in some embodiments, or may be uncut in other embodiments. Maintenance personnel manually refill the sheet product dispenser 100 and position stub roll 102 within the lower or tapered portion of the dispenser 100. This stub roll 102 is commonly referred to as a "stub roll" since it usually, but not necessarily, contains only a portion of the sheet product of a new/full sheet product roll. However, in some embodiments the stub roll 102 can be a new or full sheet product roll. Since the stub roll 102 may have less sheet product, it is able to fit within the lower portion of the sheet product dispenser 100. Full sheet product rolls may also fit within the lower portion of the sheet product dispenser 100.

In the illustrated embodiment, the main roll 104 is in the upper portion of the dispenser 100 and the stub roll 102 is in the lower portion of the dispenser 100. The dispenser 100 includes the drive roller 140 and the pinch roller 150. In other embodiments, additional pinch rollers may be included. The drive roller 140 may be driven by the motor 120, while the pinch roller 150 may follow the drive roller 140 and may be configured to force sheet product into contact with the drive roller 140. Sheet product is pulled from the stub roll 102 by the drive roller 140 and the pinch roller 150 upon activation by motor 120. The location where the driver roller 140 and the pinch roller 150 meet is commonly referred to as the "nip," generally indicated by reference 142 in FIG. 3. The drive roller 140 and the pinch roller 150 may be of any size or shape, and may be different sizes and shapes. Either or both of the drive roller 140 and the pinch roller 150 may include coatings or covers, such as rubber portions 144 on the drive roller 140 shown in FIG. 1. The drive roller 140 may include a gripping external surface, such as a rubber coated or textured external surface, to increase friction and/or reduce slip between the sheet product and the drive roller 140. Various configurations, placement, and types of the pinch roller 150 may be used in the hybrid dispenser system 100. Some embodiments of the present disclosure may not include pinch rollers and may instead include other guide mechanisms, such as guide bars or tensioners, while other embodiments may not include any guide mechanisms.

Figure 2:
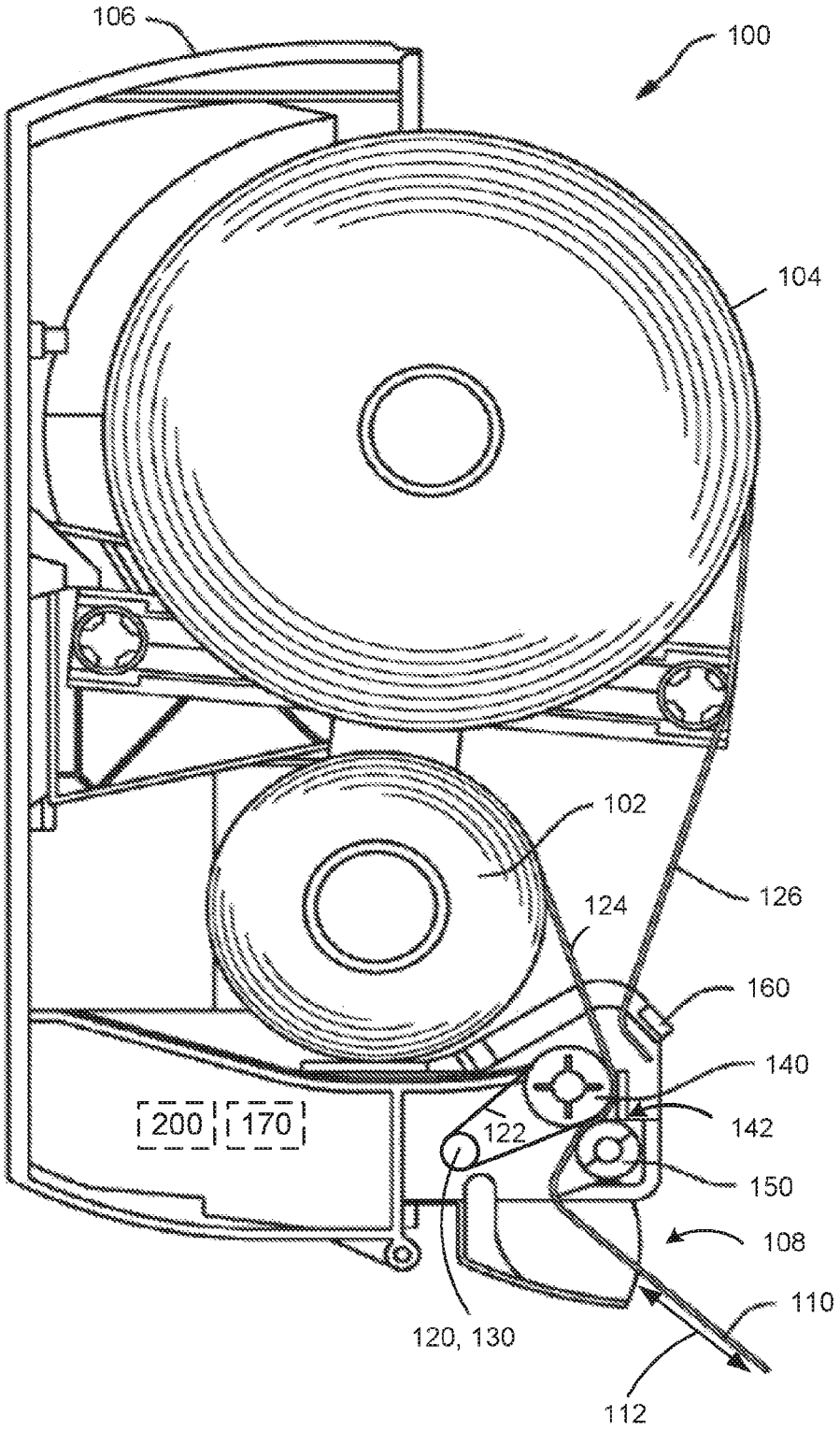
Figure 4:
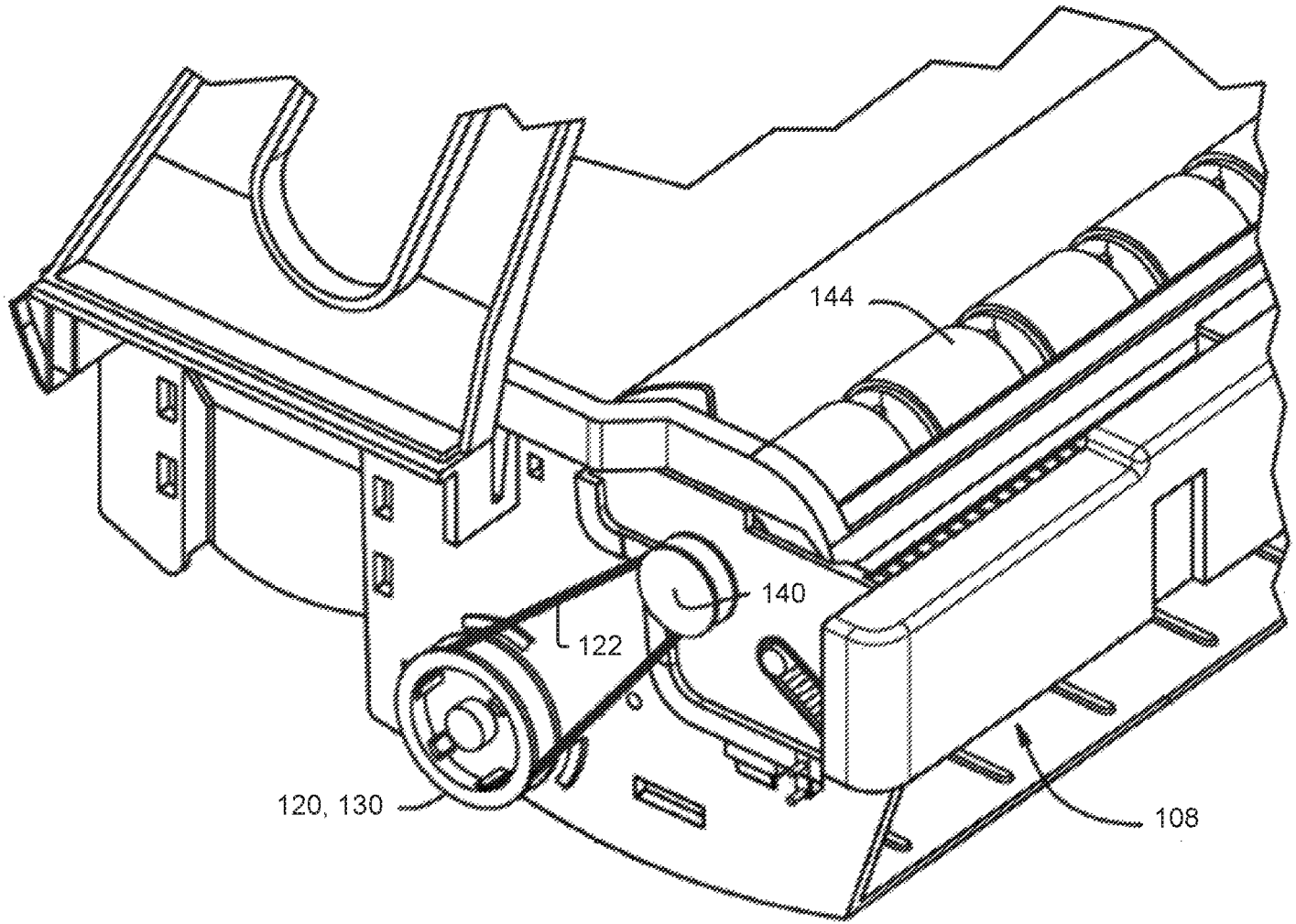
Figure 5:
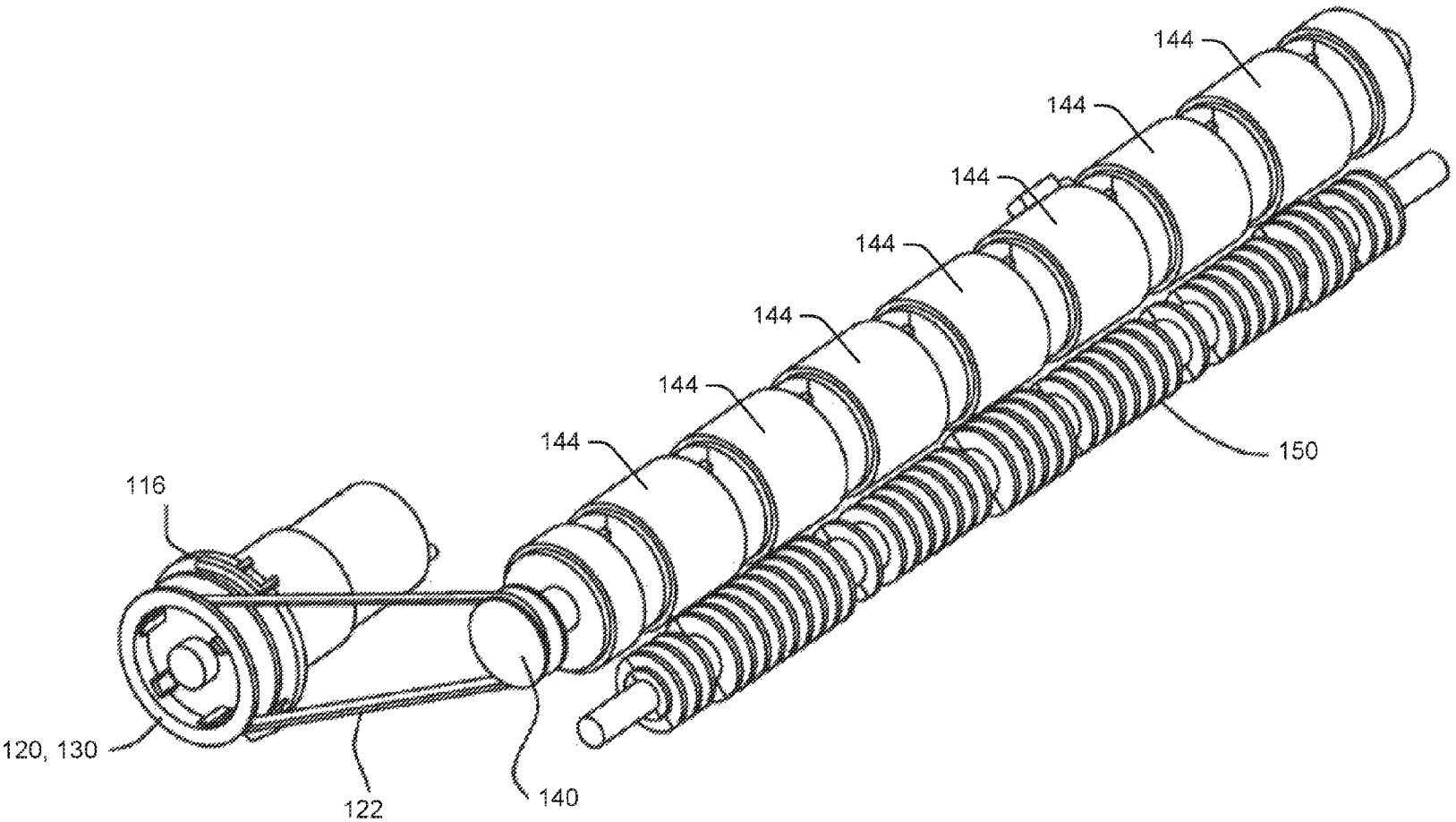

As shown in the embodiment of FIG. 2, the drive roller 140 is mechanically coupled for rotation to the motor 120 by a suitable mechanical system, such as a gear train system or pulley system. The motor 120 may be coupled to the drive roller 140 by any combination of gearing, levers, or other linkage configured to transfer motion from the motor 120 to the drive roller 140. In some embodiments, the drive roller 140 may be driven by the motor 120 or by a user manually pulling sheet product from the dispenser. As shown in FIGS. 4-5, the motor 120 is coupled to the drive roller 140 via pulley system 122. When maintenance or refill operations are performed on the sheet product dispenser 100, the stub roll 102 is positioned in the lower portion and a portion of the sheet product 124 from stub roll 102 is inserted between the drive roller 140 and the pinch roller 150 at the nip 142.

Friction between the rollers 140 and 150 and the sheet product 124 causes sheet product 124 to be pulled from the stub roll 102 when the motor 120 is activated. Maintenance personnel may also position the main roll 104 in the sheet product dispenser 100. The main roll 104 may include a portion 126 that is positioned adjacent a transfer bar 160. An arm 162 (shown in FIG. 1) on the transfer bar 160 extends substantially parallel to the drive roller 140, transversely across the front of the sheet product dispenser 100 to engage the main roll leading edge portion 126.

The hybrid dispenser system 100 may also include sensors electrically coupled to the controller 210, such as a proximity sensor 180 and a tear sensor 190, and/or regulators electrically coupled to the controller 210 and configured to sense or regulate current and/or voltage, as discussed below. The sensors and/or regulators may provide additional functionality of the hybrid dispenser system 100. For example, the proximity sensor 180 may be configured to detect a user in proximity to the dispenser system 100, and the tear sensor 190 may be configured to detect when sheet product is torn from the dispenser 100. The proximity sensor 180 may be any suitable sensor, such as an infrared sensor or a capacitive sensor for example, that is capable of sensing the presence of a user's hand in front of the sheet product dispenser 100. In some embodiments, the tear sensor 190 may be configured to detect actuation of a tear blade 192 of the dispenser system 100. Other sensors that may be included in the dispenser, or used instead of the proximity or tear sensors, include a photovoltaic sensor, an ambient light sensor, a motion sensor, a tear sensor, or another sensor.

Figure 6:
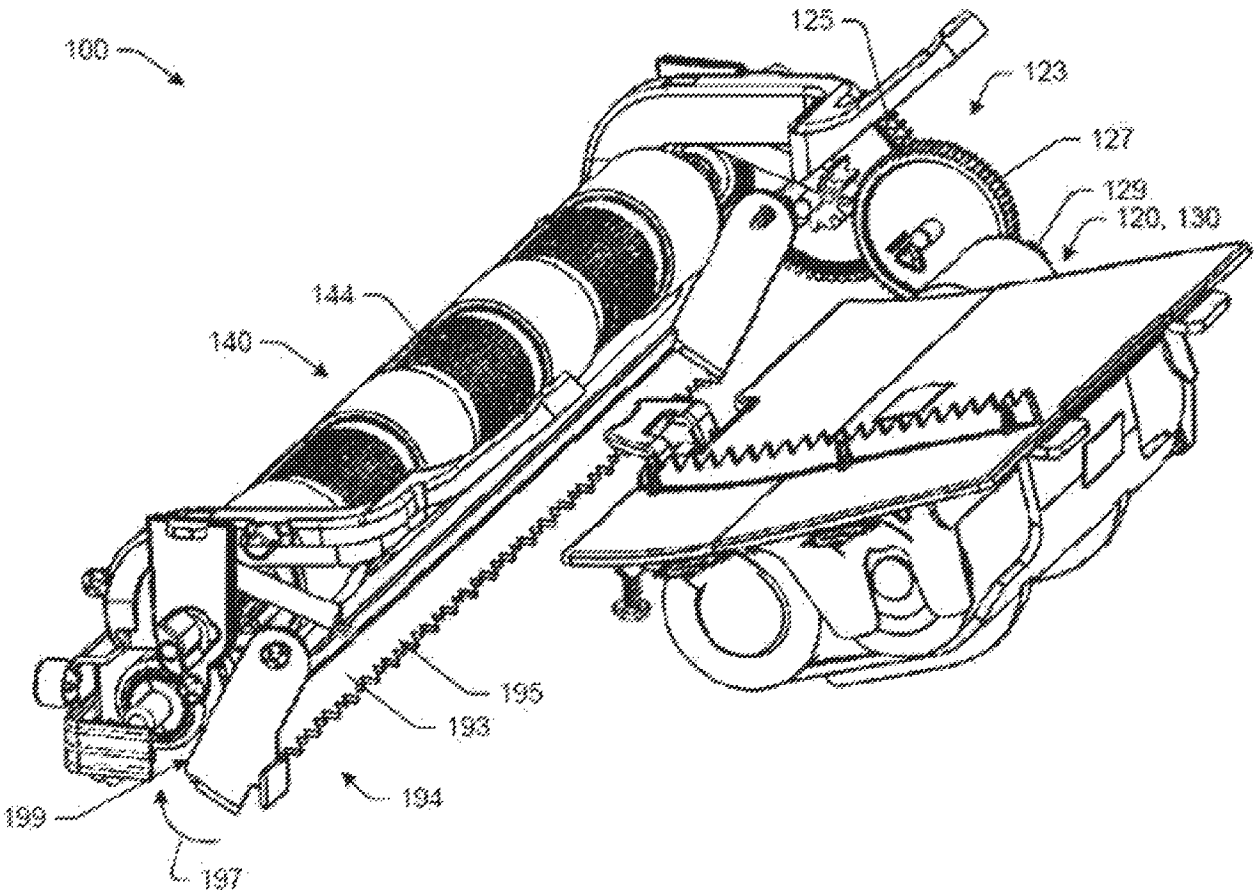
FIG. 6 illustrates a portion of a hybrid dispenser system in accordance with one or more embodiments.

The electrical generator 130 of the dispenser 100 is configured to generate electrical energy based at least in part on a length of sheet product dispensed from the hybrid dispenser system 100 during the manual dispensing portion of a dispensing cycle. Specifically, as the length of sheet product dispensed during the manual portion of the dispensing cycle increases, the amount of electrical energy generated by the generator 130 increases. Manually pulling out the sheet product rotates the drive roller 140, which mechanically drives the motor 120 due to the pulley and belt connection 122. In other embodiments, the motor 120 may be coupled to the drive roller 140 via mechanical gearing, as illustrated in FIG. 6. This results in the motor 120 acting as the electrical generator 130, producing an electric current that is used to recharge the energy storage device 200. In some embodiments, the motor 120 may be referred to as a motor-generator if it performs both functions. The electrical generator 130 may receive rotational motion from the drive roller 140 and may convert the received motion into electrical energy, which may be generated as alternating current. The electrical generator 130 may be a three phase electrical generator, including at least one pole pair, and configured to generate alternating current and oscillating output voltage. The electrical generator 130 may be a brush DC motor, in one example, or a brushless DC motor in another example. The oscillating output voltage may have three discrete voltage peaks per each pair of the at least one pole pair. The electrical generator 130 may generate any number of voltage peaks per revolution, which may be based on the total number of pole pairs of the electrical generator 130. In one example, the electrical generator 130 may generate 24 peaks per revolution, 36 peaks per revolution, or another multiple of three peaks per revolution.

The inverter 170 may be a three phase inverter, depending on the type of electrical generator 130, and may be configured to convert alternating current to direct current. The inverter 170 may be electronic or may include mechanical components. The inverter 170 may receive alternating current from the electrical generator 130 and may translate the received current from alternating current to a direct current. The input voltage of the direct current at the inverter 170 may be any standard voltage, for example 12 volts, and the output voltage of the alternating current produced by the inverter 170 may be any standard voltage, such as 6 volts, 12 volts, 120 volts or 240 volts. In some embodiments, the inverter 170 may include three single phase inverter switches connected to individual load terminals, with operation of each switch coordinated such that a single inverter switch operates at each 60 degree point of the alternating current waveform generated by the inverter 170. In an embodiment, the motor is driven with a trapezoidal waveform that has a peak voltage (typically 6-12 Volts) equal to the stored voltage in the energy storage device.

The hybrid dispenser system 100 includes the energy storage device 200. In the illustrated embodiment, the energy storage device 200 is electrically coupled to the electrical generator 130 and is configured to receive energy from the electrical generator 130. The energy storage device 200 is also electrically coupled to the dispenser 100 and configured to provide energy to the dispenser 100. For example, the energy storage device 200 may power the motor 120 of the dispenser 100. The energy storage device 200 may be any suitable device configured to store and/or provide energy, for example a rechargeable battery, including, but not limited to, nickel metal hydride, wet cells, dry cells, lead-acid, lithium, lithium hydride, lithium ion, or the like, at any suitable voltage and/or output current. Other examples of energy storage devices 160 include capacitors such as super capacitors and electric double layer capacitors, electromechanical or electromagnetic energy storage devices, and chemical energy storage devices. The energy storage device 200 may fully or partially energize the dispenser 100, thereby providing assistance to users pulling sheet product from the hybrid dispenser system 100 by reducing the pull force, or in some instances the maximum pull force, the user must exert in order to remove the sheet product. The energy storage device 200 may energize the dispenser 100 to advance the tail 110 of the sheet product to prepare the hybrid dispenser system 100 for a subsequent dispensing event. The hybrid dispenser system 100 may use energy stored in the energy storage device 200 for alternative or additional purposes. In one example, the energy storage device 200 energizes the motor 120 for dispensing a tail. In another example, the energy storage device 200 energizes the proximity sensor 180 and/or the tear bar sensor 190.

After the drive roller 140 and pinch roller 150 pull the sheet product from either the stub roll 102 or the main roll 104, the sheet product proceeds to a tear bar assembly 194. The tear bar assembly 194 is positioned adjacent the dispensing opening 108. A blade, knife edge, or other device configured to cut the sheet product is included in tear bar assembly 194, which may be used by a user to cut the sheet product once a length of sheet product has been dispensed and/or pulled from the dispenser. As described in more detail below, the tear bar assembly 194 may separate the dispensed sheet product using a sharp edge that cuts into the sheet when the user pulls the dispensed sheet product. The separated sheet product from the sheet product roll 102, 104 may then be used and discarded as desired by the user.

Figure 3:
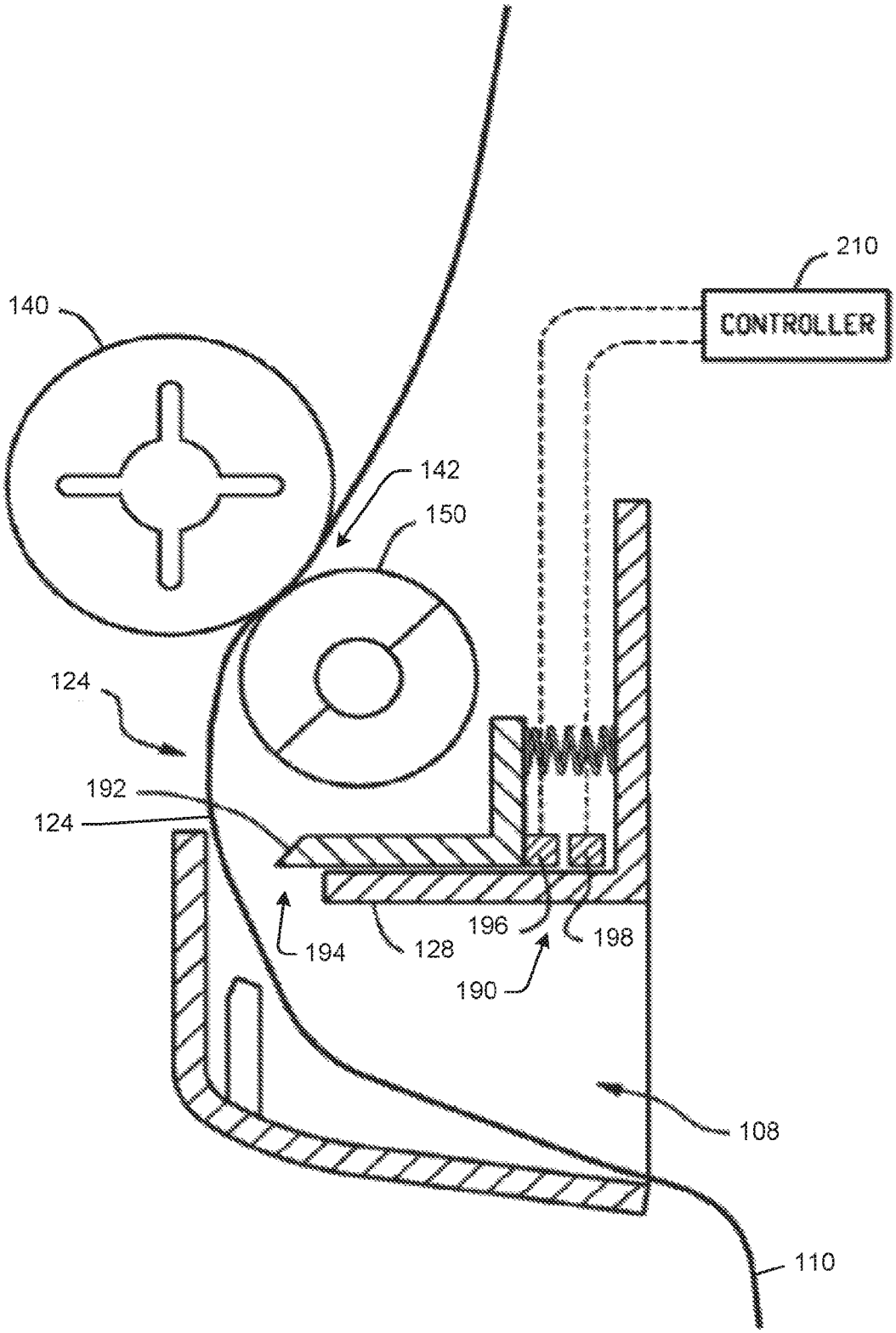

Referring to FIG. 3, the tear bar assembly 194 is positioned adjacent the dispensing opening 108 to provide a means for separating the dispensed sheet product from one of the rolls 102, 104. The tear bar 192 of the tear bar assembly 194 may be slidably coupled to a portion 128 of the dispenser 100. The tear bar 192 may be slidably fixed to the projection 128 by any suitable means, such as by having threaded fasteners captured in slots for example. The tear bar 192 is arranged to move in a direction substantially parallel to the projection 128. The tear bar 192 further includes a blade edge that is positioned adjacent the opening and adjacent the path of the sheet product leading edge portion 124. The blade edge may be a knife-edge, a serrated edge or any other suitable edge capable of cutting the sheet product leading edge portion 124 from one of the sheet product rolls 102, 104. The tear bar 192 may include a back surface at which an elastic member, such as a compression spring for example, is positioned to bias the tear bar 192 towards the sheet product 124.

The tear bar assembly 194 may include the tear sensor 190. The tear sensor 190 may include a first electrical contact 196 and a second electrical contact 198. The first electrical contact 196 is coupled a back surface of the tear bar 192 and is arranged to move with the tear bar 192. The second electrical contact 198 is positioned in a fixed arrangement relative to the housing 106 or the tear bar 192. Electrical conductors electrically couple the first electrical contact 196 and the second electrical contact 198 to the controller 210 respectively. During an operation mode, the sheet product dispenser 100 provides the exposed tail 110 of sheet product to the user via dispensing opening 108. Users may engage the tear bar assembly 194 at any time. Once a length of sheet product exits the sheet product dispenser 100, whether the length is predetermined or as desired by the user, the user pulls on the sheet product causing the sheet product in the opening 108 to engage the edge of tear bar 192. Since the tear bar 192 is slidably mounted, the tear bar 192 moves under the force of sheet product being pulled by the user. The tear bar 192 continues to move until the first electrical contact 196 comes into contact with the second electrical contact 198. The edge 144 thereafter completes the cutting of the sheet product, allowing the user to remove the separated sheet.

The tear sensor 190 provides a signal to the controller 210 that indicates whether the dispensed portion of sheet product has been separated from the sheet product dispenser 100. The contact of the electrical contacts 196, 198 also completes an electric circuit formed by the electrical contacts 196, 198 and the controller 210. The completion of this circuit allows a signal to be transmitted to the controller 210 indicating that the tear bar 192 has been moved. From this signal, the controller 210 may infer that the sheet product has been separated and that the dispensing cycle is completed. As discussed above, the controller 210 may be configured in several ways, such as deactivating or stopping the drive roller 140 immediately upon activation of the tear bar 192 for example. Alternatively, the controller 210 may operate for a short period until a subsequent exposed tail of the sheet product is dispensed, for example. The detection of the sheet product being separated by the tear bar assembly 194 may provide a positive feedback to the controller 210 to de-energize the motor 120. Thus the sheet product dispenser 100 may avoid waste and the related increased costs.

In FIG. 6, another embodiment of the hybrid dispenser system 100 is illustrated with an alternate tear bar assembly 194 and with a mechanical gearing assembly 123 coupling the motor 120 to the drive roller 140 instead of the pulley system 122 illustrated in FIGS. 4-5. The alternate tear bar assembly 194 includes a tear bar 193 with a serrated knife edge 195 configured to cut or perforate sheet product pulled against the knife edge 195. When sheet product is pulled against the knife edge 195, the tear bar 193 rotates or pivots in direction 197. When the tear bar 193 pivots in direction 197 as sheet product is pulled against the tear bar 193, the tear bar 193 may engage a switch mechanism 199 that signals to the controller 210 that a length of sheet product has been torn from the dispenser system 100. The tear bar 193 may return to its original position due to gravity after the sheet product is torn from the dispenser system 100.

The mechanical gearing assembly 123 includes a first gear 125, a second gear 127, and a third gear 129 configured to impart motion from the drive roller 140 to the motor 120 or from the motor 120 to the drive roller 140 via rotational motion. The mechanical gearing assembly 123 may include any number of gears and related gear ratios in other embodiments.

Operation

Operation of the illustrated hybrid dispenser system 100 is controlled by the controller 210. The controller 210 may be electrically and/or communicatively coupled to the dispenser 100, the electrical generator 130, and the energy storage device 200. The controller 210 may include one or more processors and/or memory components. The controller 210 may be implemented as appropriate in hardware, software, firmware, or combinations thereof. Software or firmware implementations of the controller 210 may include computer-executable or machine-executable instructions written in any suitable programming language to perform the various functions described. Hardware implementations of the controller 210 may be configured to execute computer-executable or machine-executable instructions to perform the various functions described. The controller 210 may include, without limitation, a central processing unit (CPU), a digital signal processor (DSP), a reduced instruction set computer (RISC), a complex instruction set computer (CISC), a microprocessor, a microcontroller, a field programmable gate array (FPGA), or any combination thereof. In other embodiments, operation of the hybrid dispenser system 100 may be controlled by other hardware or software arrangements, including hardware logic.

The controller 210 is a suitable electronic device capable of accepting data and instructions, executing the instructions to process the data, and presenting the results. Controller 210 may accept instructions through a user interface, or through other means such as, but not limited to, a proximity sensor, a tear sensor, voice activation means, manually-operable selection and control devices, radiated wavelength and electronic or electrical transfer. Therefore, main controller 210 can be, but is not limited to a microprocessor, microcomputer, a minicomputer, an optical computer, a board computer, a complex instruction set computer, an ASIC (application specific integrated circuit), a reduced instruction set computer, an analog computer, a digital computer, a molecular computer, a quantum computer, acellular computer, a solid-state computer, a single-board computer, a buffered computer, a computer network, a desktop computer, a laptop computer, a personal digital assistant (PDA), or a hybrid of any of the foregoing.

Controller 210 is capable of converting the analog voltage or current level provided by sensors into digital signals. For example, input from the proximity sensor 180 may be converted into a digital signal indicative of a user placing their hand in front of the sheet product dispenser 100. Alternatively, proximity sensor 180 may be configured to provide a digital signal to controller 210, or an analog-to-digital (A/D) converter may be coupled between proximity sensor 180 and controller 210 to convert the analog signal provided by proximity sensor 180 into a digital signal for processing by controller 210. Controller 210 uses the digital signals as input to various processes for controlling the sheet product dispenser 100. The digital signals represent one or more sheet product dispenser 100 data including but not limited to proximity sensor activation, stub roll empty, tear bar activation, motor current, motor back electromotive force, battery level and the like.

The controller 210 may also accept data or input devices such as motor 120. Controller 210 is also given certain instructions from an executable instruction set for the purpose of comparing the data from tear bar sensor 190 to predetermined operational parameters to determine appropriate actions. For example, if the dispenser system is in "hang mode," the controller 210 may instruct the dispenser to advance a tail of sheet product after receiving input from the tear bar sensor 190.

Controller 210 includes operation control methods embodied in application code. These methods are embodied in computer instructions written to be executed by a processor, typically in the form of software. The software can be encoded in any language, including, but not limited to, machine language, assembly language, VHDL (Verilog Hardware Description Language), VHSIC HDL (Very High Speed IC Hardware Description Language), Fortran (formula translation), C, C++, Visual C++, Java, ALGOL (algorithmic language), BASIC (beginners all-purpose symbolic instruction code), visual BASIC, ActiveX, HTML (HyperText Markup Language), and any combination or derivative of at least one of the foregoing. Additionally, an operator can use an existing software application such as a spreadsheet or database and correlate various cells with the variables enumerated in the algorithms. Furthermore, the software can be independent of other software or dependent upon other software, such as in the form of integrated software.

The dispenser 100 is configured to dispense a length of the sheet product from the hybrid dispenser system 100 upon activation during a dispensing cycle. A dispensing cycle includes an automated portion, where a tail of sheet product is automatically dispensed from the dispenser, and a manual portion where a user manually pulls the exposed tail and tears the sheet product to remove a length of sheet product from the dispenser 100. To dispense a tail during the automated portion of a dispensing cycle, the controller 210 may activate the motor 120 to dispense the tail of the sheet product. Energy generated during the manual portion of the dispensing cycle may be captured and stored, as described herein. In some embodiments, activation of the dispenser 100 to dispense a tail (during the automatic portion of the dispensing cycle) may be triggered by the proximity 180 or the tear sensor 190. For example, the dispenser 100 may be triggered to dispense a tail upon activation of the proximity sensor 180, indicating that a user is waiting at the dispenser. This instance may be referred to as an "on demand" operation mode, as the tail is dispensed on demand by a user. In another example, upon activation of the tear sensor 190, indicating that a user has torn sheet product, the dispenser 100 may be triggered to dispense another tail, so that the tail is waiting for a subsequent user to pull it. Such an instance may be referred to as "hang mode," since a tail is hanging and ready for a subsequent user at all times.

In on demand mode, the tail of the sheet product is not exposed until a user triggers the dispenser. Upon being triggered, for example upon receiving input from a proximity sensor, the controller 210 sends a dispense signal to the motor 120 in response to the proximity sensor detecting a user present. The user then initiates the manual portion of the dispensing cycle by pulling the tail to remove the second portion of the sheet from the dispenser. The energy storage device 200 is charged during the manual dispensing operation, which enables the dispenser 100 to use stored energy for other functions, which may include powering the proximity sensor or dispensing the next tail. On demand mode therefore allows the sheet product to remain hidden in the dispenser until requested, which may be more hygienic than an exposed tail. In hang mode, the tail of the sheet product is exposed as soon as a first user tears the sheet product. For example, when the first user tears the sheet product, the tear sensor sends a signal to the controller 210 which in turn sends a dispense signal to the motor 120, causing a subsequent tail to be dispensed and hang for the next user. This mode may reduce wait time between dispensing cycles. Operational modes may be selected by a switch, a user interface at a controller, or in any other manner.

Figure 7:
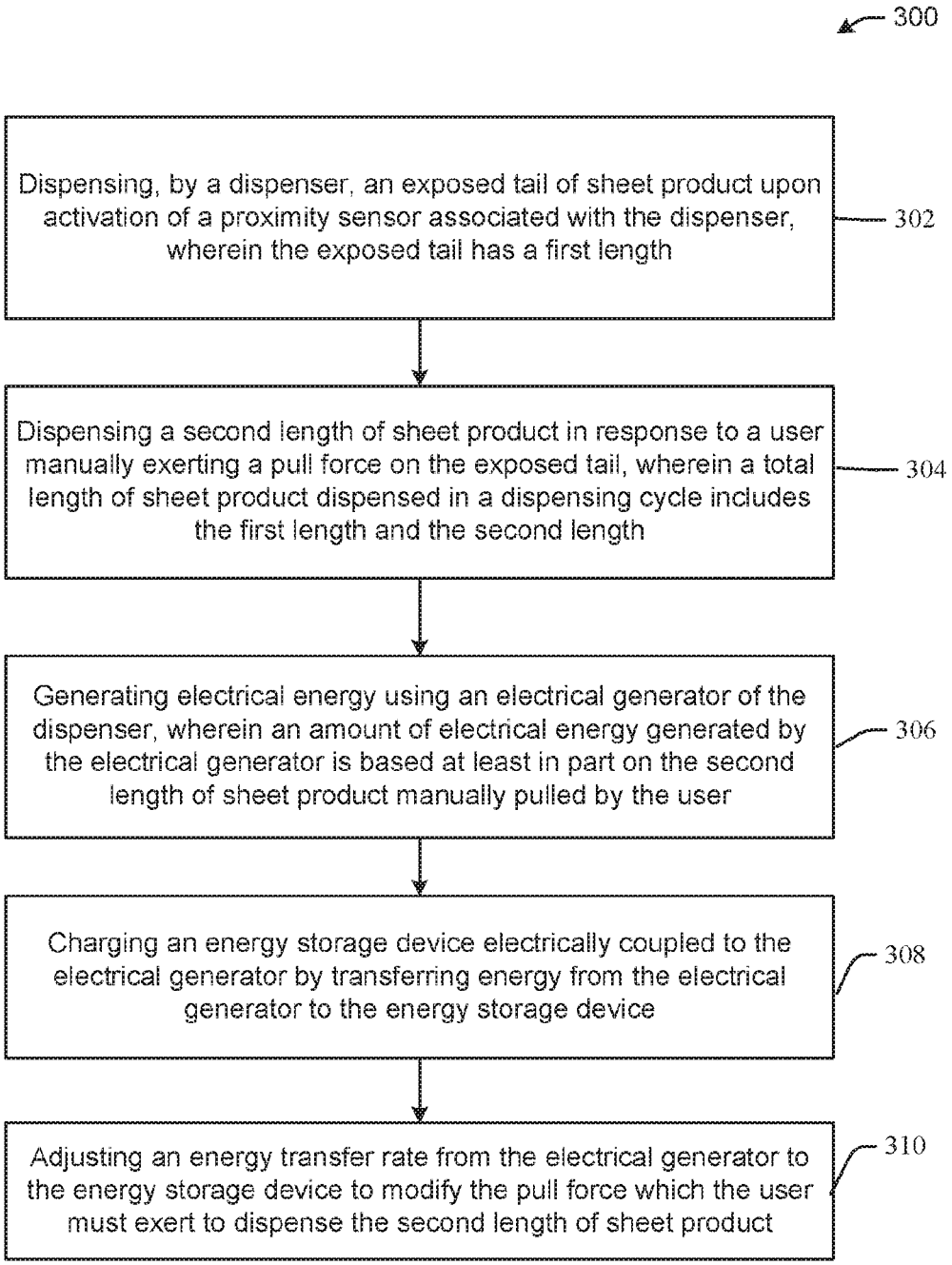
FIG. 7 illustrates an example method of dispensing sheet product from a dispenser in accordance with one or more embodiments.
Figure 8:
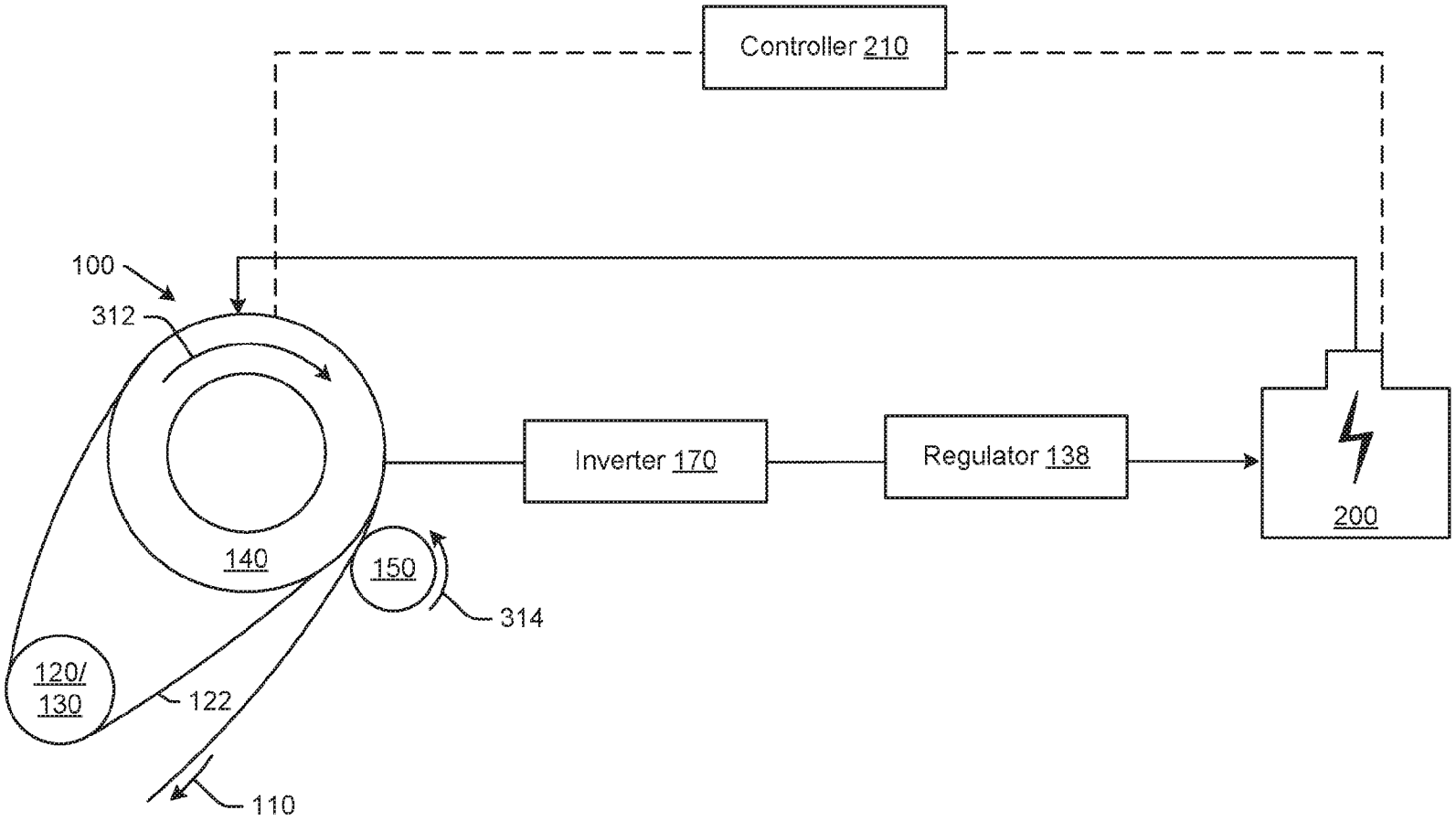
FIG. 8 schematically illustrates certain components of the hybrid dispenser of FIG. 1 in accordance with one or more embodiments.

Referring now to FIGS. 7 and 8, a method of dispensing sheet product from the hybrid dispenser 300 is illustrated in FIG. 7, and a schematic diagram of the hybrid dispenser system 100 is illustrated in FIG. 8. The method 300 will be discussed in conjunction with the schematic illustration of FIG. 8. Referring first to FIG. 7, at block 302 of method 300, the method 300 includes dispensing, by the hybrid dispenser system 100, an exposed tail of sheet product upon activation of a proximity sensor associated with the dispenser, wherein the exposed tail has a first length. The dispenser is driven by the motor to dispense the exposed tail, which then can be manually pulled from the dispenser system. The first length may be predetermined.

At block 304 of FIG. 7, the method 300 includes dispensing a second length of sheet product by manually pulling, by a user exerting a pull force on the exposed tail, wherein a total length of sheet product dispensed in a dispensing cycle includes the first length and the second length. The second length may be predetermined, for example in perforated rolls of sheet product or dispensers with rotary drum cutters configured to cut the sheet product at certain predetermined lengths. In other embodiments, users may be able to pull a desired length of sheet product and then tear the sheet product using the tear bar. The tear bar may cut whatever sheet product has been dispensed. Referring to FIG. 8, as the user pulls the second length of sheet product, the drive roller 140 of the dispenser 100 rotates in direction 312, and the pinch roller 150 rotates in opposite direction 314.

An amount of energy generated by an electrical generator of the dispenser is based on an amount of energy input at the dispenser by a user. At block 306 of FIG. 7, the method 300 includes generating electrical energy using an electrical generator of the dispenser, wherein an amount of electrical energy generated by the electrical generator is based at least in part on the second length of sheet product manually pulled by the user. In some embodiments, the amount of electrical energy generated by the electrical generator is also based on the pull force a user exerts to pull sheet product from the dispenser. The total length of sheet product dispensed is the first length (of the exposed tail) in addition to the second length manually pulled by the user. Electrical energy may be generated by the electrical generator 130 during manual pulling of sheet product by a user. Referring now to FIG. 3, as the drive roller 140 rotates, motion is imparted to the electrical generator 130. Based at least in part on the motion imparted to the electrical generator 130, the electrical generator 130 generates electrical energy by converting the rotational motion imparted by the drive roller 140 into energy. More specifically, in the illustrated embodiment, the electrical generator 130 generates alternating current and oscillating output voltage with three discrete voltage peaks per each pole pair of the electrical generator 130. Accordingly, as the length of sheet product dispensed increases, a number of rotations of the drive roller 140 increases, and increased motion is thereby imparted to the electrical generator 130. With increased motion being imparted to the electrical generator 130, increased electrical energy is generated by the electrical generator 130. Utilizing a three phase electrical generator improves energy capture due to higher efficiency and alternating current generation which is capable of being stored in an energy storage device at useable levels. Three phase generators generate oscillating voltages with high peaks, such that each time a pole is passed and a peak occurs, energy is transferred into storage. Three phase generators also have the ability to increase the number of poles present through various winding techniques and magnet utilization. A peak voltage is generated as the pole is passed and the voltage generation occurs on the subsequent winding. This may allow the energy storage device to charge up to the peak of the generator output. As noted herein, other embodiments may include electrical generators that are not three phase generators.

Figure 9B:
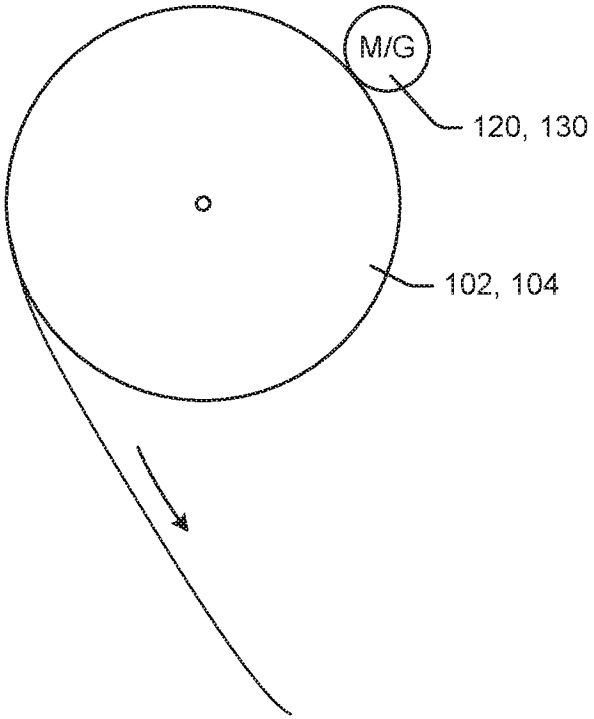
FIGS. 9A-9D illustrate examples of arrangements of a sheet product roll and an electrical generator in accordance with one or more embodiments.
Figure 9A:
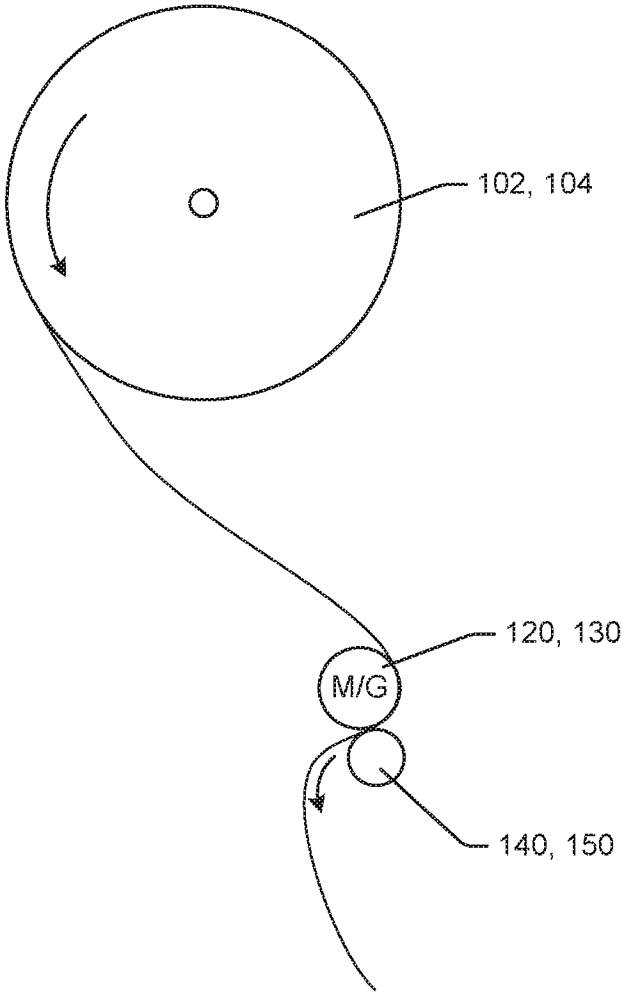
Figure 9D:
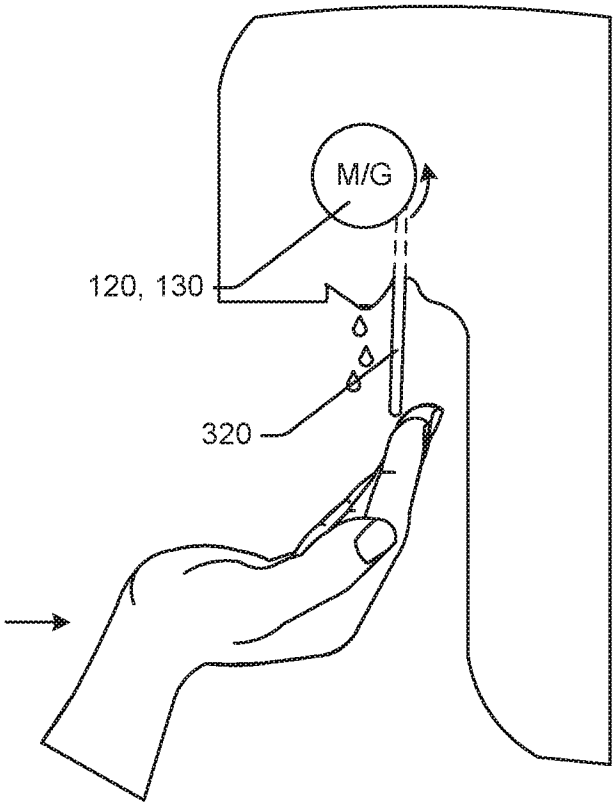
Figure 9C:
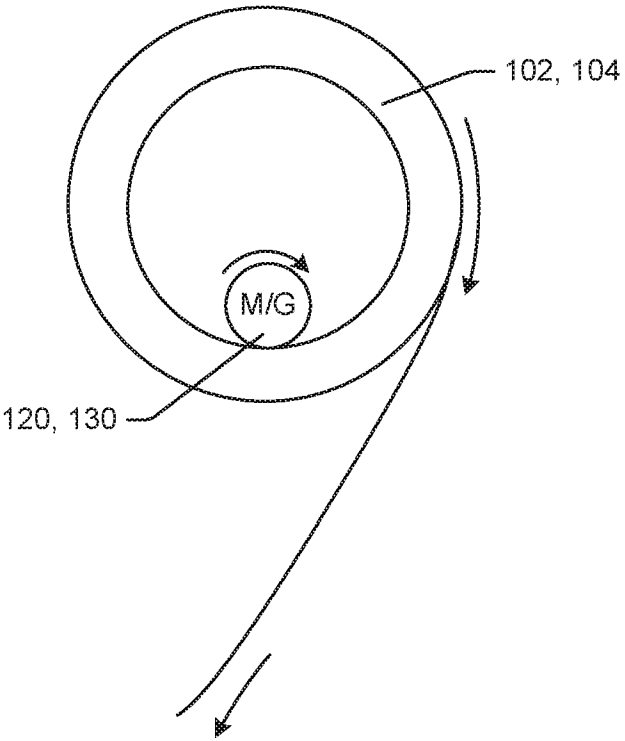

At block 308 of the method 300 in FIG. 7, the method includes charging the energy storage device 200 that is electrically coupled to the electrical generator 130 by transferring energy from the electrical generator 130 to the energy storage device 200. In FIG. 8, electrical energy generated by the electrical generator 130 flows to the energy storage device 200 as indicated by the current flow directional arrows. As electrical energy leaves the electrical generator 130, the electrical energy is received in the form of alternating current at the three phase inverter 170 and is converted to direct current. The direct current leaves the three phase inverter 170 and flows through the regulator 138 to the energy storage device 200. The energy storage device 200 receives the electrical energy from the electrical generator 130 and stores the received electrical energy. Although one embodiment of the dispenser 100 is depicted in the schematic illustration of FIG. 8, FIGS. 9A-9D illustrate alternative arrangements. For example, referring to FIG. 9A, the motor/generator 120, 130 is positioned adjacent the pinch roller 150, acting as the drive roller 140. The motor/generator 120, 130 may be driven by the drive roller via mechanical gearing. In the embodiment of FIG. 9B, the motor/generator 120, 130 is positioned adjacent to one of the sheet product rolls, for example main roll 104, and drives the main roll 104 via direct drive contact or through mechanical gearing. In FIG. 9C, the motor/generator 120, 130 is positioned inside one of the sheet product rolls, such as main roll 104, and may drive the main roll 104 via direct drive contact with the core or through mechanical gearing. In FIG. 9D, the motor/generator 120, 130 is actuated by a lever arm 320, for example in a liquid dispenser.

Referring again to FIG. 7, at block 310 of the method 300, the method includes adjusting an energy transfer rate from the electrical generator to the energy storage device to modify the pull force which the user must exert to dispense the second length of sheet product. The pull force the user must exert is modified by adjusting, in one example, current flow between the electrical generator 130 and the energy storage device 200. In some embodiments, the pull force the user must exert to dispense the second length of sheet product is modified to increase proportionally with the second length of sheet product. In some embodiments, the pull force is modified to increase after a threshold length (e.g., a fourth, a third, a half, etc.) of the second length of sheet product is dispensed. Additional examples are discussed below with reference to FIGS. 11-13.

The pull force that a user must apply to pull sheet product from the dispenser 100 may affect the user experience of the dispenser system, as well as usage and the type of sheet product that may be used with the dispenser system. In embodiments of the present disclosure, the pull force may be modifiable as a user pulls sheet product. The controller 210 may be configured to execute instructions to implement one or more pull force profiles. Accordingly, a maximum pull force may be the maximum amount of force the user must apply at any point in pulling sheet product from the dispenser. For example, a relatively high maximum pull force may negatively affect the user experience as users may have to exert more force in removing a length of the sheet product, while a relatively low maximum pull force may improve the user experience but increase usage of the sheet product beyond that amount which is needed or desired by users. Additionally, the type of sheet product that can be used in the dispenser system may be affected by the pull force. For example, with a relatively high pull force, a thin sheet product may be difficult to pull from the dispenser system, as thin sheet product may tear or rip during dispensing. However, by reducing the pull force, thinner sheet products may be used. In one example embodiment, adjusting the energy transfer rate from the electrical generator to the energy storage device includes determining a first energy transfer rate from the electrical generator to the energy storage device, and then either (i) reducing the first energy transfer rate by an amount, such as a predetermined amount of 5% or 10%, etc., to achieve a second energy transfer rate in order to reduce the pull force, (ii) increasing the first energy transfer rate by an amount to achieve a second energy transfer rate in order to increase the pull force. Accordingly, systems and methods of the present disclosure may allow for the pull force to be modified by the dispenser system.

Figure 10:
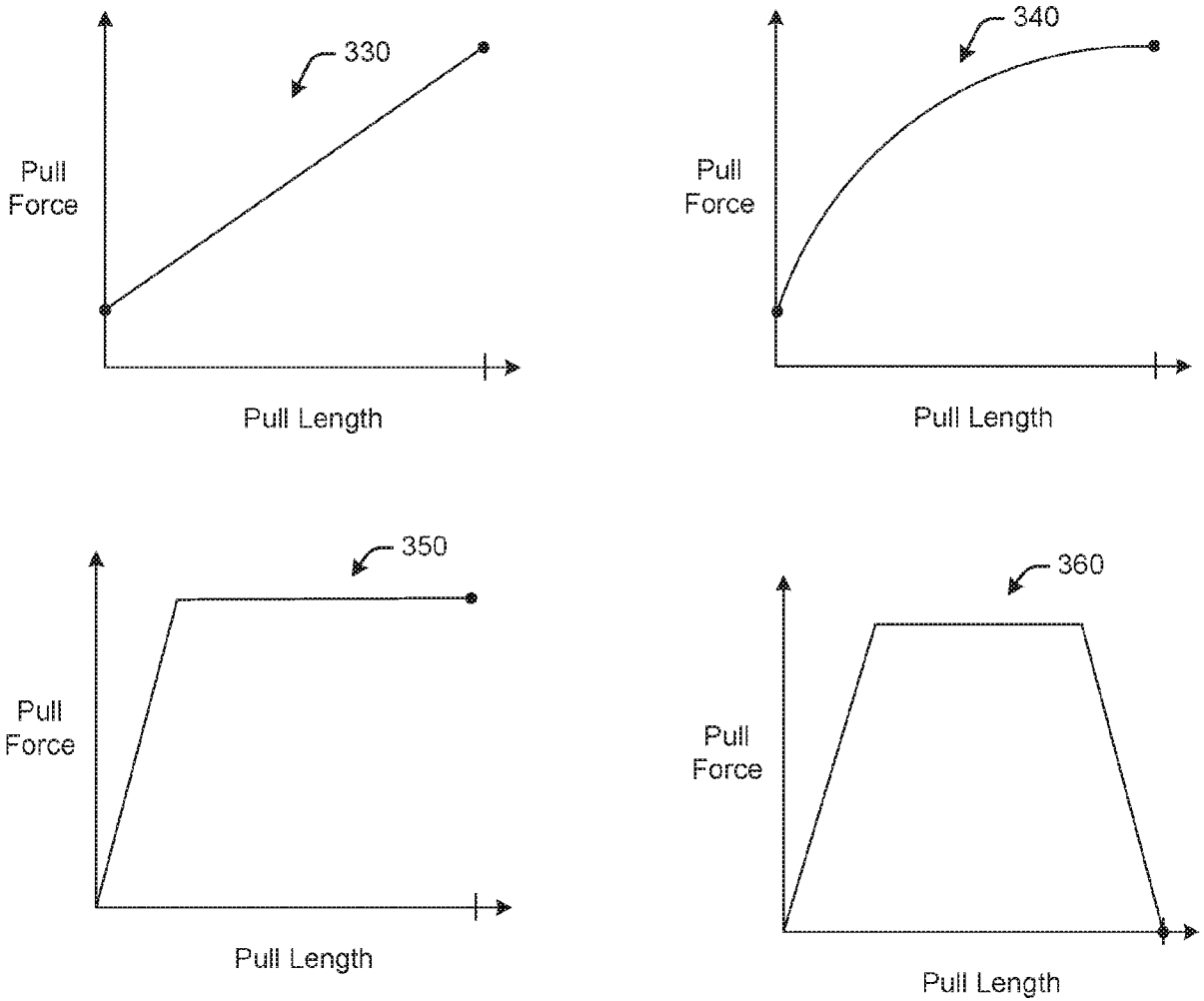
FIG. 10 illustrates example pull force profiles created by a hybrid dispenser in accordance with one or more embodiments.

FIG. 10 illustrates some examples of pull force profiles indicated by a pull force exerted by a user over a pull length that can be achieved by the systems and methods described herein. The illustrated pull force profiles may be achieved by manipulating pull force over a pull length. In a first profile 330, the pull force may increase linearly as the pull length of sheet product pulled from the dispenser increases. With the first profile 330, users may realize they have pulled a full sheet based on the increase in pull force required to pull additional sheet product. In another example, where the sheet product is perforated, the maximum pull force may correspond to the perforations in the sheet product, such that the perforation is torn at about the time the maximum pull force is reached. In a second profile 340, the pull force may increase quickly and then gradually reach a maximum pull force at a relatively high level until the sheet product is torn. The second profile 340 may result in greater energy generation by the electrical generator of the dispenser, as the user inputs more force at the dispenser to pull sheet product. In a third profile 350, the pull force may increase sharply and stay at a maximum. For the third profile 350, a relatively flat pull force during the manual portion of the dispensing cycle may indicate a lower maximum pull force the user must exert. In a fourth profile 360, the pull force may increase quickly, stay at a maximum for a period of time, and then decreases as the total length of sheet product is dispensed. In other profiles, the pull force may stay relatively low, and then suddenly increase to correspond with a perforated sheet product, resulting in a "popping" (i.e., breaking) of the perforation, to tear off a segment of the sheet product.

Figure 11:
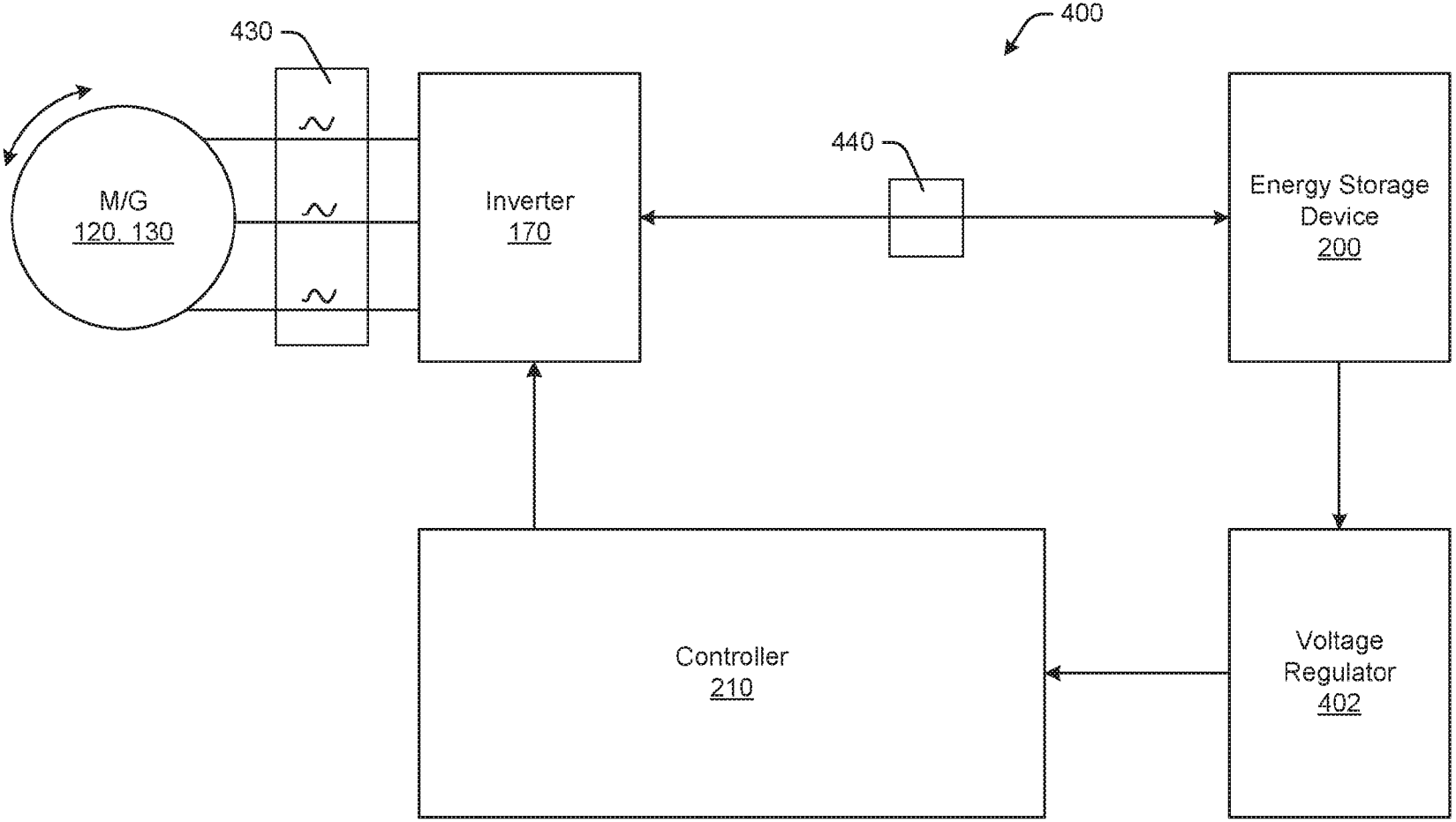
FIGS. 11-13 schematically illustrate certain components of a hybrid dispenser in accordance with one or more embodiments.
Figure 12:
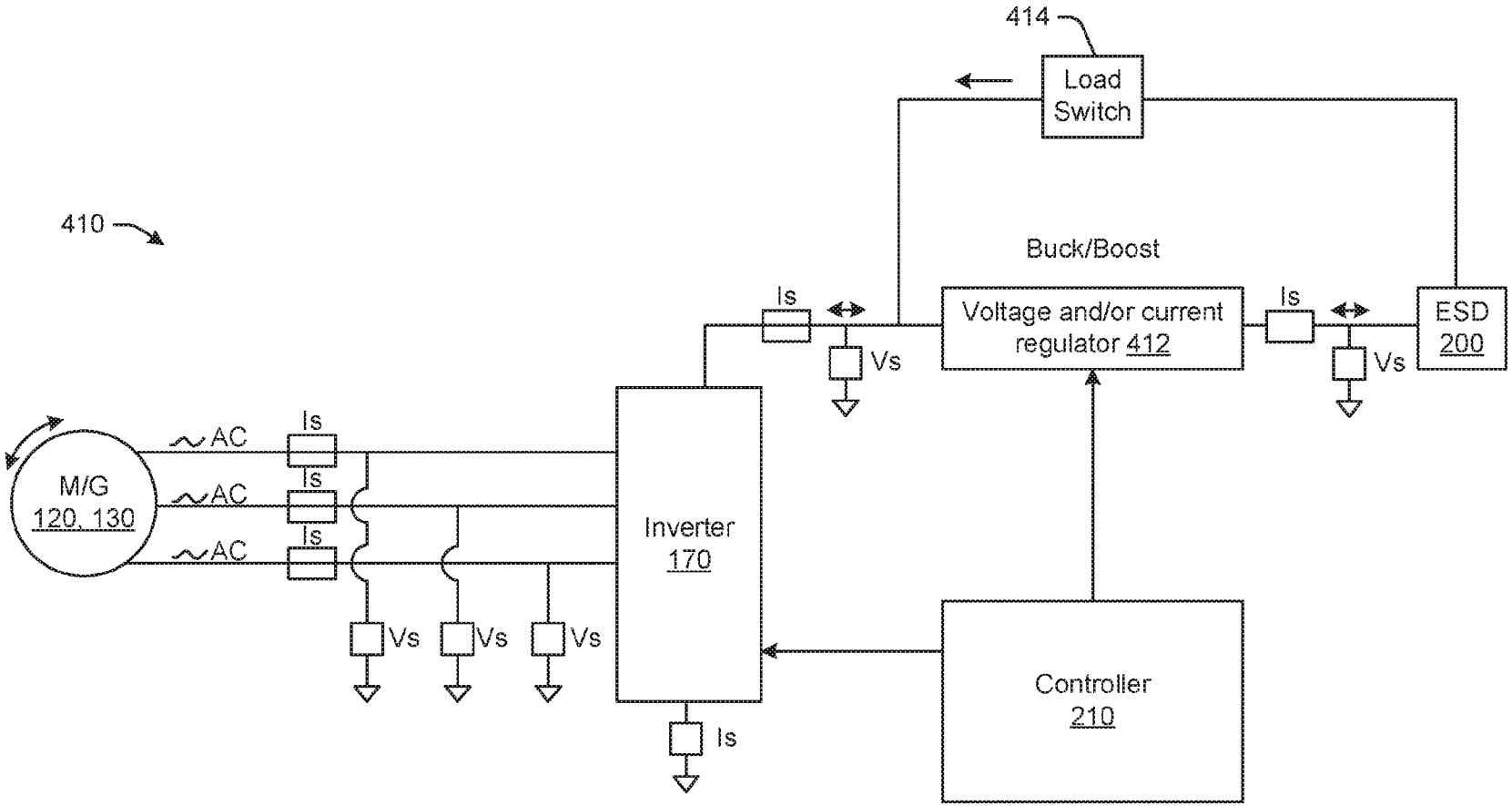
Figure 13:
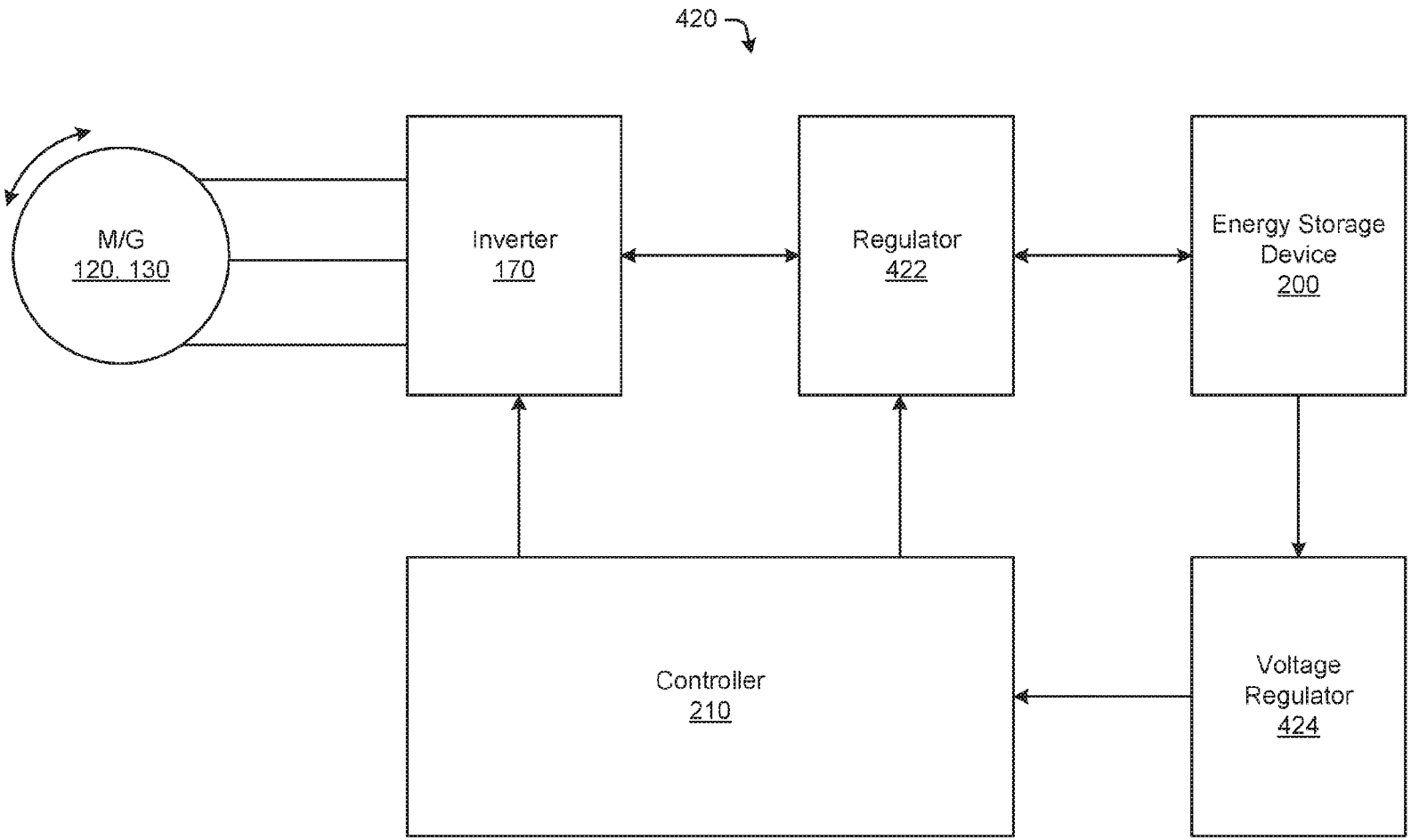

FIGS. 11-13 illustrate additional embodiments of hybrid dispenser systems. The dispensers 100 may also include one or more transformers, sensors and/or regulators to manipulate or modify current flowing through the hybrid dispenser system 100. In the embodiment shown in FIG. 11, a dispenser 400 includes a motor/generator configured to generate alternating current, which is transferred to three phase inverter 170. The three phase inverter 170 may transfer the energy to the energy storage device 200 for storage. The energy storage device 200 may transfer energy to the three phase inverter 170 for powering the motor/generator. A voltage regulator 402 may be positioned to regulate voltage output of the energy storage device 200 and/or voltage input at the controller 210.

In the embodiment shown in FIG. 12, a hybrid dispenser system 410 includes a buck-boost transformer 412 configured to regulate voltage and/or current flowing into or out of the energy storage device 200. The buck-boost transformer 412 may have a fixed boost at a desired boost percentage, for example, 10% boost. The hybrid dispenser system 410 may optionally include a load switch 414 configured to open or complete an electrical connection between the energy storage device 200 and the dispenser 100, in some embodiments.

In some embodiments, a switching regulator may be used instead of, or in addition to, the buck-boost transformer 412 in order to regulate how much charge is transferred into or out of the energy storage device 200. Referring to FIG. 13, a switching regulator 422 of a dispenser 420 may be an integrated circuit and may include an external inductor. The switching regulator 422 may therefore directly affect speed and/or torque of the electrical generator 130. A voltage regulator 424 may also be included. For example, the voltage regulator 424 may be configured to regulate voltage output at the energy storage device 200 and/or voltage input at the controller 210. Other embodiments of the hybrid dispenser system 100 may include switches, relays, inductors, or transistors, such as insulated-gate bipolar transistors or metal oxide semiconductor field effect transistors.

Referring back to the schematic illustration of FIG. 11, the hybrid dispenser systems described herein may include one or more sensors communicatively coupled to the controller 210 and configured to sense current or voltage at different positions of the hybrid dispenser system. Some embodiments may include voltage sensors and calculate current based on sensed voltage, while other embodiments may include current sensors. In FIG. 11, a first voltage sensor 430 may be configured to sense voltage output by the electrical generator 130 and/or voltage input at the inverter 170. The first voltage sensor 430 may be further configured to sense a number of voltage peaks that are output by the electrical generator 130. The hybrid dispensing system 100 includes a second voltage sensor 440 configured to sense voltage output of the inverter 170 and into energy storage device 200, or in some embodiments, a regulator, such as the buck/boost transformer 412 of FIG. 12. The first and second voltage sensors 430, 440 may communicate determined information to the controller 210, which may store the information along with chronological information. The controller 210 may determine, based at least in part on the number of voltage peaks output by the electrical generator 130, a number of revolutions of the electrical generator 130 associated with the number of voltage peaks output by the electrical generator 130. Based at least in part on the number of revolutions of the electrical generator 130, the controller 210 may determine a dispensed length of sheet product.

In an illustrative example, the electrical generator 130 is a three phase electrical generator and may have 8 pole pairs. In other embodiments, the electrical generator 130 may be another type of generator, such as a split phase generator, a two phase generator, a high phase order generator, and the like. The controller 210 may determine that, based on the specifications of the electrical generator 130, with 8 pole pairs and 3 peaks per pole pair, 24 voltage peaks are associated with one revolution of the dispenser 100. In some embodiments, the controller 210 may be pre-programmed based on a generator configuration. The controller 210 may further determine that, based on the specifications of the dispenser 100, for example, the outer circumference of the drive roller 140, one revolution of the drive roller 140 is associated with 3 inches (or 6 inches, 10 inches, etc.) of sheet product dispensed. Accordingly, the controller 210 is able to determine a dispensed length of sheet product based at least in part on the number of voltage peaks output by the electrical generator 130. Based at least in part on the time of dispensing, which may be measured or separately calculated by the controller 210, the controller 210 may determine the length of sheet product dispensed during a single dispensing event or operation. For example, a single dispensing event may be limited to a time of about 1 second (or 3 second, 5 seconds, etc.), or may be configured as desired by the operator of the hybrid dispenser system 100. In some instances, input from the tear sensor may be used to determine whether the dispensed length constitutes a single dispensing cycle. The controller 210 may store this information, along with other variables such as dispensing time, as desired. In some embodiments, gear reduction between the motor 120 and the drive roller 140 may also be considered in determining a length of dispensed sheet product. For example, gear reduction may be anywhere from 1:1 to 70:1.

The controller 210 may further calculate the total sheet product dispensed from the roll of sheet product 116. For example, upon loading the roll of sheet product 116 into the hybrid dispenser system 100, an operator may notify or reset the controller 210 to indicate a new roll of sheet product has been loaded into the hybrid dispenser system 100. The controller 210 may determine a total length of the sheet product available for dispensing, for example from a look-up table stored on a memory associated with the controller 210. The controller 210 may identify the particular roll of sheet product 150, for example, by a reference indicator placed on the roll of sheet product. The controller 210 may calculate a total length of sheet product dispensed from the roll of sheet product, based at least in part on the number of voltage peaks output by the electrical generator. The controller 210 may subtract the dispensed length of sheet product from the total length of sheet product of the roll to determine a remaining amount. In some embodiments, the controller 210 may trigger a low supply indicator, for example a light emitting diode or other indicator, to indicate to an operator the amount of sheet product remaining is below a certain threshold. The threshold may be set or changed as desired, and may be determined as a percentage, for example, 10% remaining or 5% remaining. Some embodiments may be equipped with electronic communication capabilities, for example WiFi, BLUETOOTH™, or radio frequency emitters, allowing the hybrid dispenser system 100 to transmit a notification to an operator when the amount of sheet product is below a predetermined threshold and/or when the roll of sheet product needs to be replaced.

Based on input from at least the first and second sensors 430, 440, the pull force to dispense a manual length of sheet product from the hybrid dispenser system 100 may be modifiable. In some embodiments, the pull force is affected by the amount of current flowing through the electrical generator 130. For example, the greater the amount of current flowing through the electrical generator 130 of the dispenser 100, the greater the pull force needed to manually remove sheet product from the hybrid dispenser system 100 because resistance at the drive roller 140 is increased. In order to reduce the pull force, current flowing in the electrical generator 130 may be reduced, in one example, by limiting current flowing into the energy storage device 200, thereby breaking the electrical circuit between the electrical generator 130 and the energy storage device 200, resulting in higher voltages and lower current at the dispenser 100. In another example, the pull force may be increased by increasing the current flowing in the motor 120, for example, by increasing current flowing into the energy storage device. The pull force may also be manipulated based on pull speed, in order to maximize energy capture. For example, pull force may increase with an increase in pull speed by increasing resistance at the drive roller 140, thereby generating increased energy. The controller 210 may be configured to manipulate or modify current flow through the dispenser 100 and/or the dispenser system 100.

In the illustrated embodiment, the pull force to dispense the length of sheet product may be modified by determining current flowing from the electrical generator 130 to the energy storage device 200. The controller 210 may be configured to manage the flow of voltage and/or current throughout the dispenser system. Based at least in part on the determined current, the controller 210 may either reduce current flowing to the energy storage device 200 from the electrical generator 130 in order to reduce the maximum pull force, or increase current flowing to the energy storage device from the electrical generator in order to increase the maximum pull force.

In one method of modifying the pull force, output voltage sensed at the electrical generator 130 and output current flowing out of the electrical generator 130 is determined. Based at least in part on the output voltage and output current, a pulse width modulation signal may be sent by the controller 210 to a current manipulation device such as an electrical switch (e.g., a p-channel MOSFET) configured to control current flowing into and out of the energy storage device 200. In addition, another current manipulation device, such as a current shunt (e.g., an n-channel MOSFET) configured to shunt current moving through the system to ground instead of the energy storage device 200, may be briefly shorted out. This may allow for an increase in current flowing in the motor 120. When the current shunt is turned off, or opened, the increased current may flow to the energy storage device 200. This method may result in a subsequent increase in pull force at the motor 120, and may allow energy transfer into the energy storage device 200 in situations where voltage output by the motor 120 is less that the voltage stored at the energy storage device 200. In the opposite arrangement, where current flow is reduced, the user may experience a relatively low pull force. Other embodiments may modify the current provided to the energy storage device 200 from the electrical generator 130 based at least in part on the output voltage of the electrical generator, the voltage input at the energy storage device, the current flowing into the electrical generator, or the current flowing out of the electrical generator. Other embodiments may include, but are not limited to, electrical manipulation devices to manipulate flow of current and/or voltage such as: resistors, capacitors, inductors, transformers, diodes, Zener Diodes, transient voltage suppressors, regulators, transistors, mosfets, insulated-gate bipolar transistor, operational amplifiers, comparators, application-specific integrated circuits, integrated circuits, and/or switching devices.

In some embodiments, the hybrid dispenser system 100 may be configured such that the maximum pull force increases proportionally to the length of sheet product dispensed from the hybrid dispenser system 100, while in other embodiments, the pull force may suddenly change, based at least in part on the length of sheet product dispensed from the hybrid dispenser system 100. For example, after a desired threshold length (e.g., 8 inches, 12 inches, etc.) of sheet product is dispensed, the pull force may be rapidly increased so as to indicate to the user the dispensed sheet product should be removed. In embodiment where the sheet product is perforated, the perforation may break with the sudden increase in pull force. Rapid change in pull force may be effected by shorting windings of the motor 120, thereby dramatically increasing the pull force. By modifying pull force over pull length, the controller 210 may implement a pull force profile in accordance with a pull force curve, such as those illustrated in FIG. 10.

In one way of viewing the methods and dispenser systems described herein, the method of dispensing sheet product from a dispenser includes (i) driving a dispensing mechanism of a dispenser to dispense a first portion of the sheet product, wherein the dispensing mechanism is driven using stored energy from an energy storage device; (ii) receiving input energy from a user, wherein the input energy is input into the dispenser by the user manually pulling on the sheet product to dispense the first portion of the sheet product and/or by the user manually pulling on the first portion of the sheet product; (iii) driving the dispensing mechanism of the dispenser to dispense a second portion of the sheet product, wherein the dispensing mechanism is driven using a first portion of the input energy from the user; (iv) driving an electrical generator to generate captured energy, wherein the electrical generator is driven using a second portion of the input energy from the user; and (v) controlling the transfer of captured energy from the electrical generator to the energy storage device to control the resistance experienced by the user upon pulling the sheet product, thereby modulating the force profile experienced by the user to dispense the second portion sheet product.

In another way of viewing the methods and dispenser systems described herein, the method of dispensing sheet product from a dispenser includes (i) receiving a pull force manually exerted by a user upon a length of sheet product exposed from the dispenser, wherein a first portion of the pull force drives a dispensing mechanism of the dispenser to increase the length of sheet product exposed from the dispenser and a second portion of the pull force driving an electrical generator to generate electrical energy; (ii) transferring the electrical energy from the electrical generator to an energy storage device; and (iii) controlling the transfer of electrical energy from the electrical generator to the energy storage device to control the resistance experienced by the user upon pulling the sheet product, thereby controlling the pull force required for the user to continue increasing the length of sheet product exposed from the dispenser.

In yet another way of viewing the methods and dispenser systems described herein, the method of dispensing sheet product from a dispenser includes (i) receiving a pull force manually exerted by a user on the sheet product in order to expose a length of sheet product from the dispenser, wherein a first portion of the pull force drives a dispensing mechanism of the dispenser to increase the length of sheet product exposed from the dispenser and a second portion of the pull force driving an electrical generator to generate electrical energy; (ii) transferring the electrical energy from the electrical generator to an energy storage device; and (iii) controlling the transfer of electrical energy from the electrical generator to the energy storage device to control the resistance experienced by the user upon pulling the sheet product, thereby controlling the pull force required for the user to continue increasing the length of sheet product exposed from the dispenser.

In an example embodiment, a dispenser system includes a manual dispensing mechanism that is configured to dispense sheet product when a user manually pulls on the sheet product. In an example embodiment, a user can manually pull on sheet product in order to expose a tail of sheet product having a first length. In this example embodiment, the dispensing mechanism dispenses the exposed tail in response to a pull force exerted by a user manually pulling on the sheet product. The dispenser system includes an energy storage device and an electrical generator configured to transfer energy to the energy storage device. The electrical generator is configured to generate electrical energy when the user exerts a pull force on the sheet product. For example, electrical energy is generated when the user manually pulls the sheet product from the dispenser system. The amount of electrical energy generated by the electrical generator is based at least in part on the length of sheet product manually pulled by the user. The dispenser system includes a current manipulation device configured to adjust an energy transfer rate from the electrical generator to the energy storage device to modify the pull force the user must exert to dispense the sheet product. In this embodiment, the energy harvested by the dispenser system may be distributed to an electrically coupled component so as to power the electrically coupled component. For example, an air freshener dispenser may be electrically coupled to the dispenser system and may receive power from the energy storage device where the harvested energy is stored. As a result, an air freshener dispenser may not require an independent power source for its operation.

The hybrid dispenser system 100 shown in FIG. 1 is illustrated by way of example only. Other system embodiments can include fewer or greater numbers of elements and/or components, which may perform similar or different functions and/or operations than described above. One will recognize the applicability of the disclosure to various other system embodiments.

Using the embodiments described herein, maintenance time and costs may be reduced as the dispenser systems described herein capture energy provided by users of the dispenser system to recharge an energy storage device. Additionally, the user experience associated with the dispenser systems described herein may be improved by modifying the pull force the user exerts to dispense the second length in order to remove sheet product from the dispenser system.

The operations and methods described and shown above may be carried out or performed in any suitable order as desired in various implementations. Additionally, in certain implementations, at least a portion of the operations may be carried out in parallel. Furthermore, in certain implementations, less than or more than the operations described may be performed.

These computer-executable program instructions described herein with respect to the controller 210 may be loaded onto a special-purpose computer or other particular machine, a processor, or other programmable data processing apparatus to produce a particular machine, such that the instructions that execute on the computer, processor, or other programmable data processing apparatus create means for implementing one or more functions specified in the flow diagram block or blocks. These computer program instructions may also be stored in a computer-readable storage media or memory that can direct a computer or other programmable data processing apparatus to function in a particular manner, such that the instructions stored in the computer-readable storage media produce an article of manufacture including instruction means that implement one or more functions specified in the flow diagram block or blocks. As an example, certain implementations may provide for a computer program product, comprising a computer-readable storage medium having a computer-readable program code or program instructions implemented therein, said computer-readable program code adapted to be executed to implement one or more functions specified in the flow diagram block or blocks. The computer program instructions may also be loaded onto a computer or other programmable data processing apparatus to cause a series of operational elements or steps to be performed on the computer or other programmable apparatus to produce a computer-implemented process such that the instructions that execute on the computer or other programmable apparatus provide elements or steps for implementing the functions specified in the flow diagram block or blocks.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language is not generally intended to imply that features, elements, and/or operations are in any way required for one or more implementations or that one or more implementations necessarily include logic for deciding, with or without user input or prompting, whether these features, elements, and/or operations are included or are to be performed in any particular implementation.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense only and not for purposes of limitation.

I claim:

1. A method of dispensing sheet product from a dispenser, the method comprising:

dispensing, by the dispenser, an exposed tail of sheet product upon activation of a proximity sensor associated with the dispenser, wherein the exposed tail has a first length;

dispensing a second length of sheet product in response to a user manually exerting a pull force on the exposed tail, wherein a total length of sheet product dispensed in a dispensing cycle includes the first length and the second length;

generating electrical energy using an electrical generator of the dispenser, wherein an amount of electrical energy generated by the electrical generator is based at least in part on the second length of sheet product manually pulled by the user;

charging an energy storage device electrically coupled to the electrical generator by transferring energy from the electrical generator to the energy storage device; and adjusting an energy transfer rate from the electrical generator to the energy storage device to modify the pull force which the user must exert to dispense the second length of sheet product.

2. The method of claim 1, wherein the electrical generator is a three phase electrical generator comprising at least one pole pair, and is configured to generate alternating current and oscillating output voltage with three discrete voltage peaks per each of the at least one pole pair.

3. The method of claim 2, further comprising:

determining a number of voltage peaks output by the three phase electrical generator;

determining a number of revolutions of the three phase electrical generator associated with the number of voltage peaks; and calculating the total length of sheet product dispensed based at least in part on the number of revolutions.

4. The method of claim 3, wherein the number of voltage peaks output by the three phase electrical generator are determined during the dispensing cycle.

5. The method of claim 1, further comprising:

determining output voltage flowing out of the electrical generator;

determining voltage input at the energy storage device; and determining current flowing out of the electrical generator.

6. The method of claim 5, wherein:

the pull force the user must exert to dispense the second length of sheet product is modified by manipulating the current flowing out of the electrical generator to the energy storage device based at least in part on the output voltage of the electrical generator, the voltage input at the energy storage device, or the current flowing out of the electrical generator, such that increasing the current flow results in increased pull force and decreasing the current flow results in decreased pull force.

7. The method of claim 6, wherein the current flowing out of the electrical generator to the energy storage device is manipulated with a MOSFET device.

8. The method of claim 1, wherein the pull force the user must exert to dispense the second length of sheet product is modified to increase proportionally to the second length of sheet product during the dispensing of the second length of sheet product.

9. The method of claim 1, wherein the pull force the user must exert to dispense the second length of sheet product is modified to increase after a threshold length of the second length of sheet product is dispensed during the dispensing of the second length of sheet product.

10. The method of claim 1, wherein adjusting the energy transfer rate from the electrical generator to the energy storage device comprises:

determining a first energy transfer rate from the electrical generator to the energy storage device; and then either (i) reducing the first energy transfer rate by an amount to achieve a second energy transfer rate in order to reduce the pull force, or (ii) increasing the first energy transfer rate by an amount to achieve a second energy transfer rate in order to increase the pull force.

11. The method of claim 1, wherein the electrical generator is a brush direct current electrical generator comprising at least one pole pair, the electrical generator configured to generate direct current.

12. A dispenser system comprising:

a dispensing mechanism configured to dispense an exposed tail of sheet product having a first length;

an energy storage device configured to power the dispensing mechanism;

an electrical generator configured to transfer energy to the energy storage device, the electrical generator configured to generate electrical energy when a user, exerting a pull force on the exposed tail, manually pulls a second length of sheet product from the dispenser system, wherein an amount of electrical energy generated by the electrical generator is based at least in part on the second length of sheet product manually pulled by the user; and a current manipulation device configured to adjust an energy transfer rate from the electrical generator to the energy storage device to modify the pull force the user must exert to dispense the second length of sheet product.

13. The dispenser system of claim 12, wherein the dispensing mechanism dispenses the exposed tail of sheet product upon activation.

14. The dispenser system of claim 13, further comprising a proximity sensor configured to activate the dispensing mechanism, wherein the energy storage device is configured to power the proximity sensor.

15. The dispenser system of claim 14, wherein the proximity sensor activates the dispensing mechanism upon detecting the user in proximity to the dispenser system.

16. The dispenser system of claim 13, further comprising a tear sensor configured to activate the dispensing mechanism, wherein the tear sensor activates the dispensing mechanism upon detecting that a length of sheet product has been separated from the dispenser system by the user.

17. The dispenser system of claim 16, wherein the tear sensor comprises a tear bar positioned about an outlet of the dispenser system.

18. A dispenser system comprising:

a dispensing mechanism;

a proximity sensor configured to activate the dispensing mechanism to dispense an exposed tail of sheet product having a first length;

an energy storage device configured to power the dispensing mechanism and the proximity sensor;

an electrical generator configured to transfer energy to the energy storage device, the electrical generator configured to generate electrical energy when a user, exerting a pull force on the exposed tail, manually pulls a second length of sheet product from the dispenser system, wherein an amount of electrical energy generated by the electrical generator is based at least in part on the second length of sheet product manually pulled by the user; and a current manipulation device configured to adjust an energy transfer rate from the electrical generator to the energy storage device to modify the pull force the user must exert to dispense the second length of sheet product.

19. The system of claim 18, wherein the electrical generator is a three phase electrical generator comprising at least one pole pair, the electrical generator configured to generate alternating current and oscillating output voltage with three discrete voltage peaks per each of the at least one pole pair.

20. The system of claim 19, further comprising:

a first sensor configured to determine a number of voltage peaks output by the three phase electrical generator; and a controller comprising a memory having computer-executable instructions operable to, when executed by at least one processor, enable the at least one processor to implement a method comprising:

determining a number of revolutions of the three phase electrical generator associated with the number of voltage peaks; and calculating the total length of sheet product dispensed based at least in part on the number of revolutions.

21. The system of claim 20, wherein the current manipulation device is a MOSFET device.

22. A dispenser system comprising:

a manual dispensing mechanism configured to dispense sheet product;

an energy storage device;

an electrical generator configured to transfer energy to the energy storage device, the electrical generator configured to generate electrical energy when a user, exerting a pull force on the sheet product, manually pulls a length of sheet product from the dispenser system, wherein an amount of electrical energy generated by the electrical generator is based at least in part on the length of sheet product manually pulled by the user; and a current manipulation device configured to adjust an energy transfer rate from the electrical generator to the energy storage device to modify the pull force the user must exert to dispense the length of sheet product.

23. A method of dispensing sheet product from a dispenser, the method comprising:

dispensing, by the dispenser, a length of sheet product in response to a user manually pulling on the sheet product;

generating electrical energy using an electrical generator of the dispenser, wherein an amount of electrical energy generated by the electrical generator is based at least in part on the length of sheet product manually pulled by the user;

charging an energy storage device electrically coupled to the electrical generator by transferring energy from the electrical generator to the energy storage device; and adjusting an energy transfer rate from the electrical generator to the energy storage device to modify the pull force which the user must exert to dispense the length of sheet product.

* * * * *